US007810804B2

(12) United States Patent
Mori

(10) Patent No.: US 7,810,804 B2
(45) Date of Patent: Oct. 12, 2010

(54) PRINTING SYSTEM, CONTROL METHOD THEREOF, AND PRINTING APPARATUS

(75) Inventor: Junichi Mori, Kawasaki (JP)

(73) Assignee: Canon Kabushiki Kasiha, Tokyo (JP)

( * ) Notice: Subject to any disclaimer, the term of this patent is extended or adjusted under 35 U.S.C. 154(b) by 0 days.

(21) Appl. No.: 12/398,069

(22) Filed: Mar. 4, 2009

(65) Prior Publication Data

US 2009/0224467 A1 Sep. 10, 2009

(30) Foreign Application Priority Data

Mar. 4, 2008 (JP) ..... 2008-053660

(51) Int. Cl.
*B65H 43/00* (2006.01)

(52) U.S. Cl. ..... 271/176; 399/383; 399/405

(58) Field of Classification Search ..... 271/176; 399/43, 81, 383, 405

See application file for complete search history.

(56) References Cited

U.S. PATENT DOCUMENTS 6,496,660 B2 * 12/2002 Takahashi et al. ..... 399/16
2004/0190057 A1 9/2004 Takahashi et al.

* cited by examiner

*Primary Examiner*—David H Bollinger
(74) *Attorney, Agent, or Firm*—Canon USA Inc IP Div

(57) ABSTRACT

In order to maintain stackability while taking printing conditions into consideration, a control method for controlling a printing system for a stacking unit stacking a sheet printed by a printing unit, includes: determining whether or not a predetermined number of sheets on which the same printed data is printed by the printing unit are stacked continuously by the stacking unit; and controlling, in a case where a predetermined number of the sheets on which the same printed data is printed are determined by the determining unit to be continuously stacked by the stacking unit, the stacking unit so as to not continuously stack more of the sheets on which the same printed data is printed than the predetermined number of sheets.

17 Claims, 34 Drawing Sheets

FIG. 13

SETTING ERROR

THE FOLLOWING CONDITIONS HAVE BEEN SET, WHICH MAY RESULT IN AN UNSTABLE LOAD.
PLEASE MODIFY THE FOLLOWING CONDITIONS.

[LARGE-QUANTITY STACKING PROCESSING]

[GROUP SORTING]

[NUMBER OF COPIES > 4000 (MAXIMUM NUMBER OF SHEETS OF THE SAME SHEET TO BE LOADED CONTINUOUSLY)]

CLOSE

1301

FIG. 15

| LARGE-QUANTITY STACKER FULL ERROR |
| --- |
| THE LARGE-QUANTITY STACKER IS FULL, SO SHEETS CANNOT BE DISCHARGED.<br>PLEASE REMOVE THE SHEETS IN THE LARGE-QUANTITY STACKER. |

FIG. 19

| LARGE-QUANTITY STACKER FULL WARNING |
| --- |
| THERE IS A LARGE-QUANTITY STACKER FULL OF SHEETS.<br>PLEASE REMOVE THE SHEETS IN THE LARGE-QUANTITY STACKER. |

FIG. 25

CONFIRMATION

CONDITION SETTINGS MAY CAUSE AN UNSTABLE LOAD DUE TO LARGE-QUANTITY STACKING, SO PRINTING HAS BEEN PERFORMED BY CHANGING THE FOLLOWING CONDITIONS.

BEFORE CHANGE: GROUP SORTING → AFTER CHANGE: NON-GROUP SORTING

CLOSE

PRINTING SYSTEM, CONTROL METHOD THEREOF, AND PRINTING APPARATUS

BACKGROUND OF THE INVENTION

1. Field of the Invention

The present invention relates to a printing system control method, and printing apparatus, more specifically, usage cases such as multiple printed media being stacked in massive numbers.

2. Description of the Related Art

In conventional printing, issuance of printed articles (sheets) has been performed through various processes. For example, there are processes such as receiving a document, application of a design as to this document, layout editing, comprehensive layout (presentation with printing), proofing (layout correction and color correction), proof printing, mechanical creating, printing, post-processing processes, sending, and so forth.

Also, in conventional printing, an offset reproduction printer has been employed at a printing process, which needs a mechanical creating process. However, a created mechanical cannot be readily corrected, so correction for a mechanical results in increase in costs. Accordingly, mechanical creating needs elaborate proofing, i.e., elaborate layout check, and elaborate color confirmation work. Therefore, it has taken a long time up to issuance of printed articles.

Also, there have been large-scale apparatuses employed for the respective processes, which need technical knowledge, and accordingly, a skilled person's expertise is vital to employ such apparatuses.

With regard to such a situation, in recent years, a POD (Print On Demand) printing system has been proposed (see USP publication-before-examination US-2004 No. 0190057), which employs a printing apparatus using electrophotography or printing apparatus using inkjet. Such a POD printing system eliminates necessity for such mechanical creating, and other complicated work.

However, in a case of assuming realization of such a POD printing system, various types of problems are expected. For example, with the POD market, mass-printed articles (sheets such as printed sheets) are continuously ejected, so there is employed a paper ejecting apparatus capable of stacking thousands of sheets. This paper ejecting apparatus is specifically a finisher (large-capacity stacker) with a dolly expected to handle mass-printed articles, and to employ an offline post-processing apparatus.

If mass-printed articles (e.g., 5000 sheets) according to the same document page (same image) are printed and stacked in the same direction continuously, the following problems are caused. Specifically, in the above-mentioned stacking mode, portions on which much toner (color material) is disposed land at the same position, which causes a great stacking height difference between a portion on which much toner is disposed and a portion on which little toner is disposed, even though the difference in thickness is slight on one sheet. As a result thereof, a problem is expected wherein a stacked sheet bundle becomes unstable in its stacked state, such that the stacked sheet bundle is inclined, or the sides at the time of stacking are curved or shifted, or the stacked sheet bundle shifts and falls. Further, if such a situation continues for long time, there is a possibility that bending of the stacked sheets will remain.

That is to say, though a slight thickness difference as to one sheet, if thousands of sheets are overlaid, the difference becomes several centimeters, which is not insignificant. For example, let us say that, such as a printed article 3101 shown in FIG. 31, 5000 sheets of printed articles (the printed contents may differ) where an image on which much toner is disposed is printed on the left side, and a text image on which little toner is disposed is printed on the right side, have been stacked continuously.

In this case, in a state in which the sheets have been stacked, for example, the left side on which much toner is disposed is a stacking height of 110 cm, but the right side on which little toner is disposed is a stacking height of 103 cm, and accordingly, there is a possibility that a problem will be caused for the sheet bundle such as inclination, shifting, shifting and falling, bending, or the like.

Accordingly, stacking a massive number of sheets, on which images where much toner is disposed at the same position are printed, continuously in the same ejecting destination, has to be avoided.

SUMMARY OF THE INVENTION

An embodiment of the present invention provides a printing system, and control method thereof which overcome the above-mentioned problems.

An aspect of the present invention provides a printing system for sheets printed by a printing unit being stacked by a stacking unit, including a determining unit configured to determine whether or not a predetermined number of sheets on which the same printed data is printed by the printing unit are stacked continuously by the stacking unit; and a control unit configured, in a case where determination is made that a predetermined number of the sheets on which the same printed data is printed by the printing unit are stacked continuously by the stacking unit, to control the stacking unit so as to not continuously stack more of the sheets on which the same printed data is printed than the predetermined number of sheets.

Further features of the present invention will become apparent from the following description of exemplary embodiments with reference to the attached drawings.

BRIEF DESCRIPTION OF THE DRAWINGS

The accompanying drawings, which are incorporates in and constitute a part of the specification, illustrate embodiments of the invention and, together with the description, serve to explain the principle of the invention.

FIG. 13 is a diagram illustrating a content example of error display in step S1207 in FIG. 12.

FIG. 15 is a diagram exemplifying a message for guiding removal of sheets in step S1407 in FIG. 14.

FIG. 19 is a diagram illustrating a warning display example in step S1811 in FIG. 18.

FIG. 25 is a diagram illustrating an ex-post confirmation message in a case of conditions settings leading to unstable large-quantity stacking, when the stacking method is automatically changed from the group sorting to the non-group sorting to execute printing.

DESCRIPTION OF THE EMBODIMENTS

Preferred embodiments for implementing the present invention will be described below based on the attached drawings. Note that, as a matter of convenience, the present embodiments will be described by being divided into such first, and second embodiments, but the present invention is not restricted to this. For example, with the present embodiment, an arrangement will be exemplified wherein control regarding a large-capacity stacker is performed by a control unit 205 wherein printed media up to the maximum 5000 sheets can be stacked. With the present embodiment, an arrangement will be described wherein, upon a setting (e.g., any of a group sorting mode, color printing mode, photo printing mode, and duplex printing mode) wherein stacking restriction (number-of-sheets restriction) should be performed being performed over an operating unit 204, the number of printed media to be supplied to this large-capacity stacker is restricted by the control unit 205. For example, let us say that determination is made that the above-mentioned setting has been performed. In this case, the control unit 205 inhibits the same large-capacity stacker from stacking printed media up to 5000 sheets. In this case, the control unit 205 controls (restricts) the stacking amount at the this large-capacity stacker so as to be suppressed to 3000 sheets serving as another predetermined threshold which is smaller than the upper limit number of sheets such as 5000 sheets (referred to "upper limit value" or "maximum permitted number of sheets"). Thus, an arrangement for realizing an arrangement for restricting the stacking amount (stacking number of sheets/stacking height) of printed media at the large-capacity stacker depending on a print job to be processed, by the control unit 205 will be described as the present embodiment. The present embodiment may be applied as long as an arrangement similar to this arrangement is provided.

First Embodiment

Figure 1:
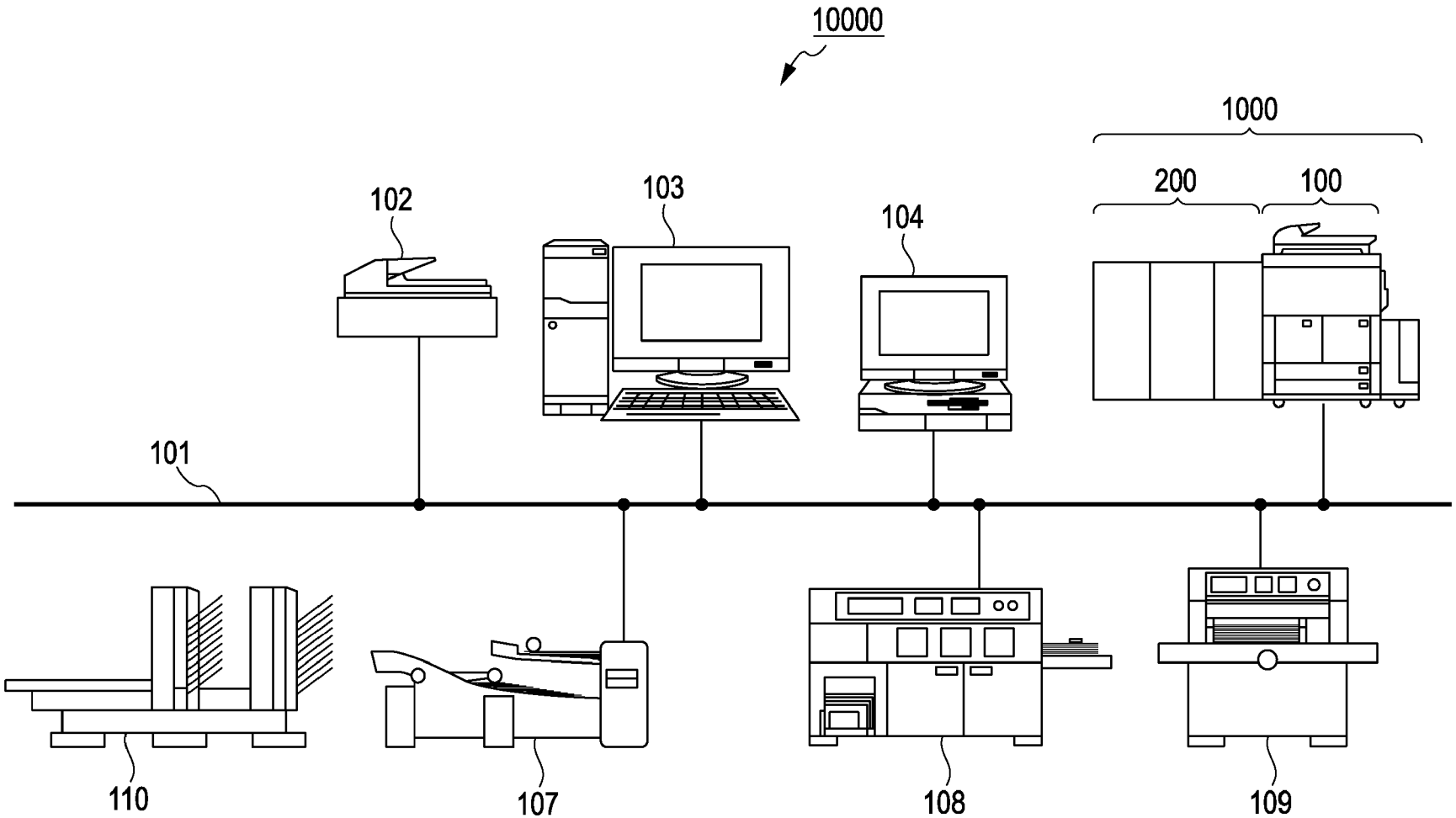
FIG. 1 is a system configuration diagram illustrating the configuration of a POD system to which a printing system according to a first embodiment of the present invention has been applied.

FIG. 1 is a system configuration diagram illustrating the configuration of a POD system to which a printing system according to a first embodiment of the present invention has been applied. A POD system 10000 in FIG. 1 includes a printing system 1000, scanner 102, server computer 103 (PC 103), and client computer 104 (PC 104), which are connected through a network 101. Also, the POD system 10000 includes a folding unit 107, trimming unit 109, saddle-stitch binding unit 110, case work binding unit 108, and so forth.

The printing system 1000 includes a printing apparatus 100, and sheet processing device 200. Note that, with the present embodiment, an MFP (Multi Function Peripheral) having multiple functions such as a copy function, printer function, and so forth is assumed as the printing apparatus 100. However, the printing apparatus 100 may be a single-function-type printing apparatus having a copy function alone or printer function alone.

The PC 103 manages transmission/reception of data as to various types of devices connected to the network 101. The PC 104 transmits image data to the printing apparatus 100 or PC 103 through the network 101. Also, the folding unit 107 performs folding processing for sheets printed by the printing apparatus 100. The case work binding unit 108 performs case work binding processing for sheets printed by the printing apparatus 100. The trimming unit 109 performs trimming processing for sheets printed by the printing apparatus 100 for each sheet bundle made up of multiple sheets. The saddle-stitch binding unit 110 performs saddle-stitch binding processing for sheets printed by the printing apparatus 100.

Figure 3:
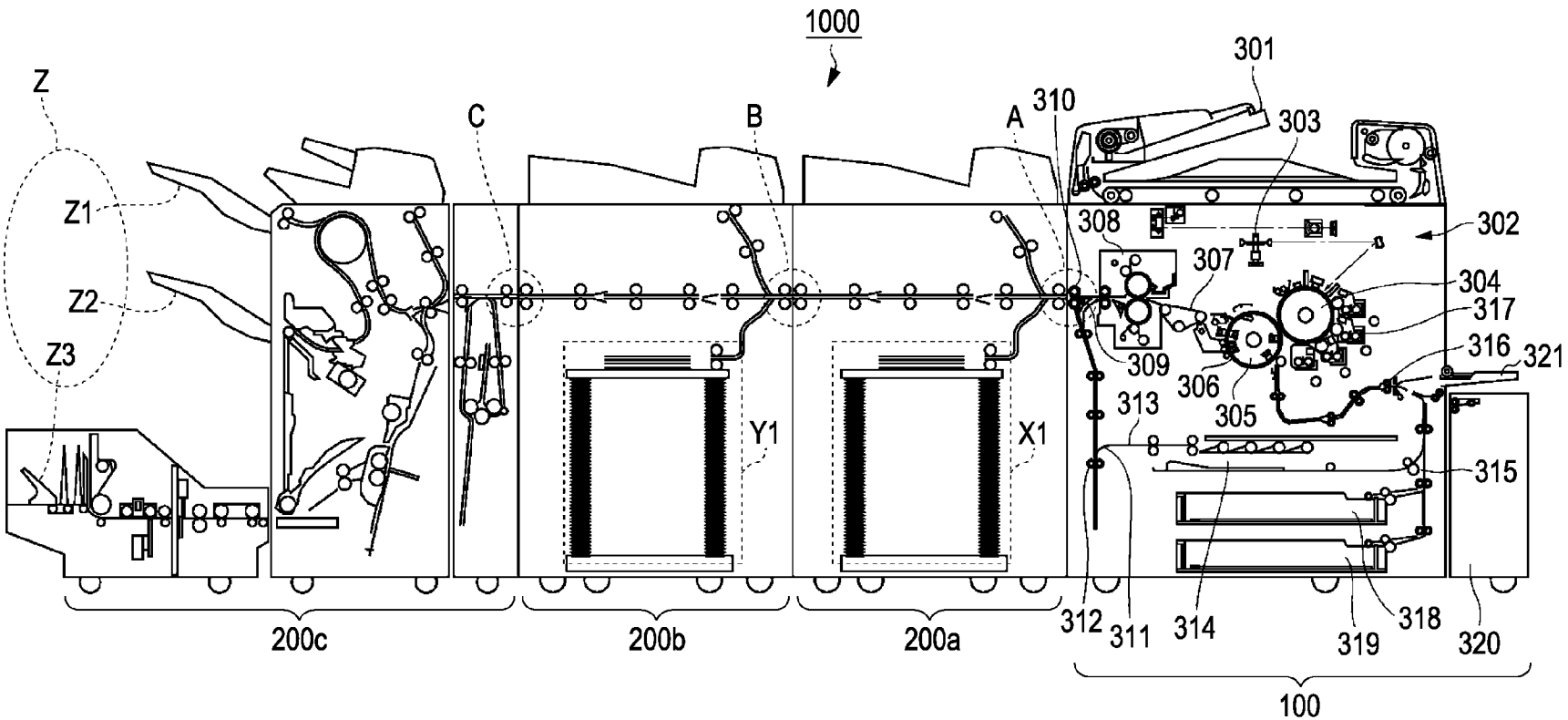
FIG. 3 is a cross-sectional view of the printing system in FIG. 1.

In a case of employing the folding unit 107, case work binding unit 108, trimming unit 109, and saddle-stitch binding unit 110, a user (synonymous with operator) takes out sheets printed by the printing apparatus 100 from the printing system 1000, and sets these in an employed device, and causes the device thereof to execute processing. However, for example, as shown in FIG. 3, in a case of connecting a device such as the saddle-stitch binding unit 110 or the like to the printing apparatus 100 as a sheet post-processing device of the printing system 1000, there is no need to take out sheets from the printing system 1000 to set to the device according to the connection.

Note that, of the multiple devices included in the POD system 10000 in FIG. 1, the devices other than the saddle-stitch binding unit 110 are connected to the network 101, and are configured so as to perform data communication with another device mutually.

Also, the term "sheet" in the present embodiment may be used interchangeably with the terms "sheet member" or "printed media", which are the same meaning.

Figure 2:
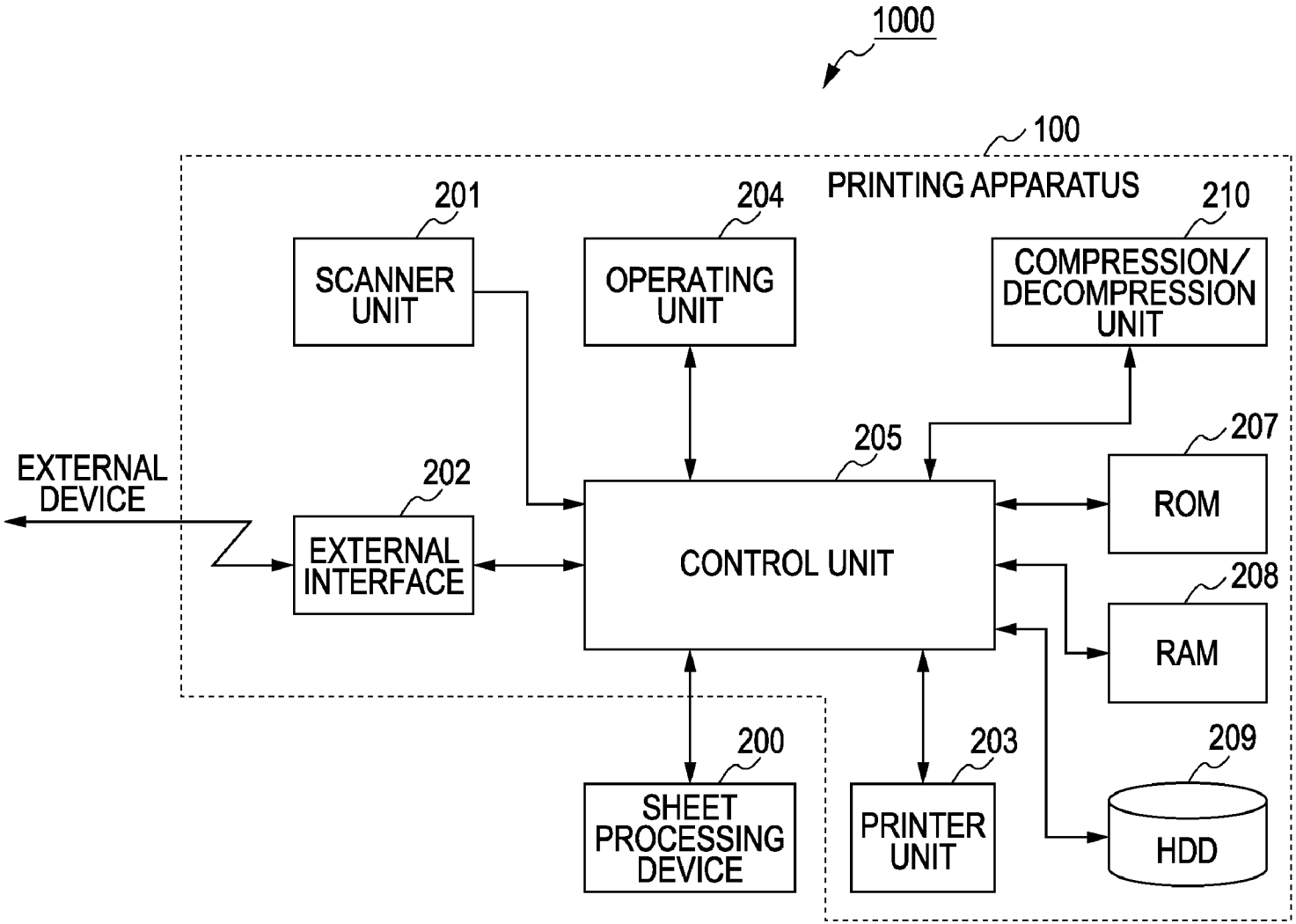
FIG. 2 is a block diagram illustrating an internal configuration example of the printing apparatus in FIG. 1.

Next, the electrical configuration of the printing system 1000 will be described with reference to the block diagram in FIG. 2. The units other than the sheet processing device 200 shown in FIG. 2 are all included in the printing apparatus 100. The printing apparatus 100 can be connected with an arbitrary number of sheet processing devices 200. With the printing system 1000, sheet processing as to sheets subjected to printing processing at the printing apparatus 100 can be executed by the sheet processing device 200 connected to the printing apparatus 100. However, the system 1000 may be configured of the printing apparatus 100 alone without connected the sheet processing device 200.

The sheet processing device 200 is configured so as to communicate with the printing apparatus 100, and can execute later-described sheet processing in response to instructions from the printing apparatus 100. The scanner unit 201 reads an image on a document optically, converts the optical image thereof into image data by a photoelectric conversion element (not shown), and transfer this to another unit. The external interface 202 performs transmission/reception of data with another device connected to the network 101.

The printer unit 203 performs printing processing for forming an image on a sheet, for example, by an electro-photographing system based on input image data. The operating unit 204 includes a later-described hard key input unit (key input unit) 602, and touch panel unit 601 (see FIG. 6), data input and operation instructions from the user are accepted through these. That is to say, not only the mode and so forth of the system but also a GUI (Graphical User Interface) screen are displayed on the touch panel 601, and the user can input various types of setting information and commands (including a job) on the GUI screen thereof through key operations or the like.

The control unit 205 centrally controls processing, operation, and so forth of various types of unit included in the printing system 1000. That is to say, the control unit 205 also controls the operations of the printing apparatus 100, and sheet processing device 200 connected.

ROM 207 stores various types of computer program executed by the control unit 205. For example, the ROM 207 stores a program causing the control unit 205 to execute various types of processing according to later-described flowcharts in FIGS. 12, 14, 16 through 18, and 23 through 24, and a display control program necessary for displaying later-described various types of setting screens (GUI screens).

Also, the ROM 207 stores a program for the control unit 205 interpreting PDL (page description language) code data received from the PC 103, PC 104, or the like to execute operation for rendering this into raster image data. Additionally, the ROM 207 stores boot sequence, font information, and so forth.

RAM 208 stores image data transmitted from the scanner unit 201 or external interface 202, various types of program, and setting information loaded from the ROM 207. Also, the RAM 208 stores information relating to the sheet processing device 200, for example, the number of sheet processing devices 200 (0 through n) connected to the printing apparatus 100, information relating to the function of the sheet processing device 200 according to the connection, connection sequence of the sheet processing devices 200, and so forth.

An HDD (Hard Disk Drive) 209 is configured of a hard disk, a driving unit for performing reading/writing of data as to the hard disk, and so forth. The HDD 209 is a large-capacity storage device, and is employed for storing image data input from the scanner unit 201 or external interface 202, and compressed by a compression/decompression unit 210. However, the HDD (Hard Disk Drive) 209 may store data for performing processing specific to the first through third embodiments, such as a program for the control unit 205 executing various types of processing according to later-described flowcharts in FIGS. 12, 14, 16 through 18, and 23 through 24.

The control unit 205 can have the printer unit 203 print image data stored in the HDD 209 based on instructions from the user. Also, the control unit 205 can also transmit the image data stored in the HDD 209 to the external device such as the PC 103 or the like through the external interface 202 based on instructions from the user. The compression/decompression unit 210 compresses/decompresses the image data or the like stored in the RAM 208 or HDD 209 by various types of compression method such as JBIG, JPEG, or the like.

Next, the mechanical configuration of the printing system 1000 will be described based on FIG. 3. FIG. 3 is a cross-sectional view of the printing apparatus 100, and the sheet processing device 200 connected to the printing apparatus 100.

An automatic document feeder (ADF) 301 separates a document bundle set in the stacking face of a document tray in page order from the first page sequentially, and conveys this onto a document table glass to scan this by the scanner 302.

The scanner 302 reads an image of the document conveyed onto the document table glass to convert this into image data by a photoelectric conversion element (such as a CCD or the like). When a laser beam modulated based on image data is input for example, a rotating polygon mirror (polygon mirror or the like) 303 reflects the laser beam thereof to expose and scan a photosensitive drum 304. An electrostatic latent image is formed on the photosensitive drum 304 according to this exposure scanning. This electrostatic latent image is developed as a toner image by a developer 317. This toner image is transferred to a sheet adhered on a transfer drum 305.

Such series of image forming processes are executed upon each color toner (image data) of yellow (Y), magenta (M), cyan (C), and black (K), thereby forming a full color image. The sheet on the transfer drum 305 on which a full color image is formed is separated from the transfer drum 305 by a separating claw 306, and conveyed to a fixer 308 by a pre-fixing conveyer 307.

The fixer 308 includes a heating roller, pressure roller, and so forth, and toner on the sheet on which a toner image is transferred is fused and fixed by heat and pressure. An ejecting flapper 309 is configured so as to swing on a swing axis, and regulates the conveying direction of the sheet. When the ejecting flapper 309 swings in the clockwise direction in FIG. 3, the sheet is conveyed so as to go straight ahead, and is ejected to the outside of the printing apparatus 100 by an ejecting roller 310 (conveyed to the inner portion of the sheet processing device 200). The control unit 205 controls the printing apparatus 100 so as to execute simplex printing according to this sequence.

On the other hand, in a case of executing duplex printing wherein an image is formed on both sides of a sheet, the ejecting flapper 309 swings in the counter-clockwise direction in FIG. 3, and the sheet of which the course is changed downward is conveyed in a duplex conveyer. The duplex conveyer includes a reversal flapper 311, reversal roller 312, reversal guide 313, and duplex tray 314. The reversal flapper 311 swings on the swing axis, and regulates the conveying direction of the sheet.

In a case of processing a duplex print job, the control unit 205 swings the reversal flapper 311 in the counter-clockwise direction in FIG. 3. Subsequently, the control unit 205 performs control so as to convey the sheet of which the first face is printed to the reversal guide 313 by the reversal roller 312. Next, the control unit 205 temporarily stops the reversal roller 312 in a state wherein the trailing edge of the sheet is pinched by the reversal roller 312, subsequently swings the reversal flapper 311 in the clockwise direction in FIG. 3, and also rotates the reversal roller 312 in the reverse direction. Thus, the sheet is switched back and conveyed, and is temporarily stacked in the duplex tray 314 in a state where the trailing edge and leading edge thereof is switched.

Subsequently, the sheet on the duplex tray 314 is conveyed to a registration roller 316 by a refeeding roller 315 again. At this time, the sheet is conveyed in a state wherein the reverse face at the time of transfer of the first face faces to the photosensitive drum 304. Subsequently, the control unit 205 forms, in the same way as the above-mentioned process, the second face image on the second face of the sheet. Subsequently, the control unit 205 executes fixing processing as to the sheet to eject the sheet to the outside of the printing apparatus 100 through the ejecting roller 310. The control unit 205 controls the printing apparatus 100 so as to execute duplex printing in accordance with such a sequence.

Also, the printing apparatus 100 include a paper feeder for feeding stored sheets. The paper feeder is configured of paper feed cassettes 318 and 319, paper feed deck 320, manual feed tray 321, and so forth. The paper feed cassettes 318 and 319 are, for example, capable of storing 500 sheets each, and the paper feed deck 320 is, for example, capable of storing 5000 sheets. The paper feed cassettes 318 and 319, and paper feed deck 320 can store various types of sheets of which the sizes and materials differ, individually. Also, various types of sheets including a particular kind of sheet such as an OHP sheet or the like can be set in the manual feed tray 321. A paper feed roller is provided in each of the paper feed cassettes 318 and 319, paper feed deck 320, and manual feed tray 321, and the stored sheets are continuously fed one sheet at a time by the paper feed roller.

Next, the sheet processing device 200 shown in FIG. 3 will be described. The printing apparatus 100 can be connected with arbitrary number of arbitrary type of devices as the sheet processing device 200 as long as sheets can be conveyed from the upstream device to the downstream device through a sheet conveying path. For example, as shown in FIG. 3, in the order closer to the printing apparatus 100, a large-capacity stacker 200*a*, large-capacity stacker 200*b*, and saddle-stitch binding unit 200*c* are connected in this order, and these can be selectively employed at the printing apparatus 100. Also, each of the sheet processing devices 200 includes a sheet ejecting unit individually, and the user can take out processed sheets from the sheet ejecting unit of each of the sheet processing devices 200.

The control unit 205 accepts an execution request for the sheet processing selected by the user through the operations of the operating unit 204 from executable sheet processing candidates at the sheet processing device 200 connected to the printing apparatus 100. Subsequently, the control unit 205 accepts an execution request for printing processing relating to a job specified by the user through the operations of the operating unit 204, and executes the printing processing relating to the job thereof at the printer unit 203.

Next, the control unit 205 conveys the sheet subjected to the printing processing relating to the job to the sheet processing device 200 for executing the sheet processing requested by the user through the sheet conveying path, and executes the sheet processing by the sheet processing device. For example, let us say that in a case of the system configuration of the printing system 1000 shown in FIG. 3, the job specified by the user is a job for performing large-quantity stacking processing by the large-capacity stacker 200*a*. This job will be referred to as "stacker job".

In a case of executing this stacker job, the control unit 205 conveys the sheets relating to the job printed by the printing apparatus 100 to the inner portion of the large-capacity stacker 200*a* passing through a connection point A in FIG. 3. Subsequently, the control unit 205 executes the stacking processing relating to this stacker job by the large-capacity stacker 200*a*. Subsequently, the control unit 205 holds the sheets (printed article) subjected to the large-quantity stacking processing at the large-capacity stacker 200*a* at an ejecting destination X1 within the large-capacity stacker 200*a* without conveying to another device (e.g., device of the subsequent stage).

The user can take out the printed article held at the ejecting destination X1 in FIG. 3 directly from the ejecting destination X1. Accordingly, this eliminates the necessity for a series of device operation and the user's work such that the sheets are conveyed in the sheet conveying direction in FIG. 3 up to an ejecting destination Z(Z1 or Z2 or Z3) farthest downstream, and the printed article is taken out from the ejecting destination Z(Z1 or Z2 or Z3).

Further, for example, let us say that a job to be processed of which the printing execution request has been accepted from the user with the system configuration in FIG. 3, is a job including sheet processing by the saddle-stitch binding unit 200*c*. In this case, examples of the sheet processing by the saddle-stitch binding unit 200*c* include stapling processing, trimming processing, hole-punching processing, folding processing, shift ejecting processing, and saddle-stitch binding processing. Here, this job will be referred to as "saddle-stitch binding job".

In a case where this saddle-stitch binding job is processed with the system configuration in FIG. 3, the control unit 205 convey the sheets relating to the saddle-stitch binding job printed by the printing apparatus 100 to the saddle-stitch binding unit 200*c* passing through points A, B, and C. Subsequently, the control unit 205 executes the sheet processing as to the sheets conveyed to the saddle-stitch binding unit 202*c* by the saddle-stitch binding unit 200*c*. Subsequently, the control unit 205 holds the printed article subjected to the sheet processing by the saddle-stitch binding unit 200*c* at the ejecting destination Z of the saddle-stitch binding unit 200*c*.

Note that there are multiple ejecting destination candidates at the ejecting destination Z. These multiple ejecting destinations where the saddle-stitch binding unit 200*c* can execute the above-mentioned multiple types of sheet processing, are employed at the time of dividing into ejecting destinations for each sheet processing.

As described with reference to FIGS. 1 through 3, with the printing system 1000 according to the present embodiment, multiple sheet processing devices can be connected to the printing apparatus 100. Subsequently, these multiple sheet processing devices can be connected to the printing apparatus 100 in an arbitrary combination. Also, the connection order of these multiple sheet processing devices can also be changed arbitrarily within a range where the sheet conveying path between the devices can be connected. Also, there are multiple types of sheet processing device candidates which can be connected to the printing apparatus 100.

Internal Configuration of Sheet Processing Device 200

Figure 4:
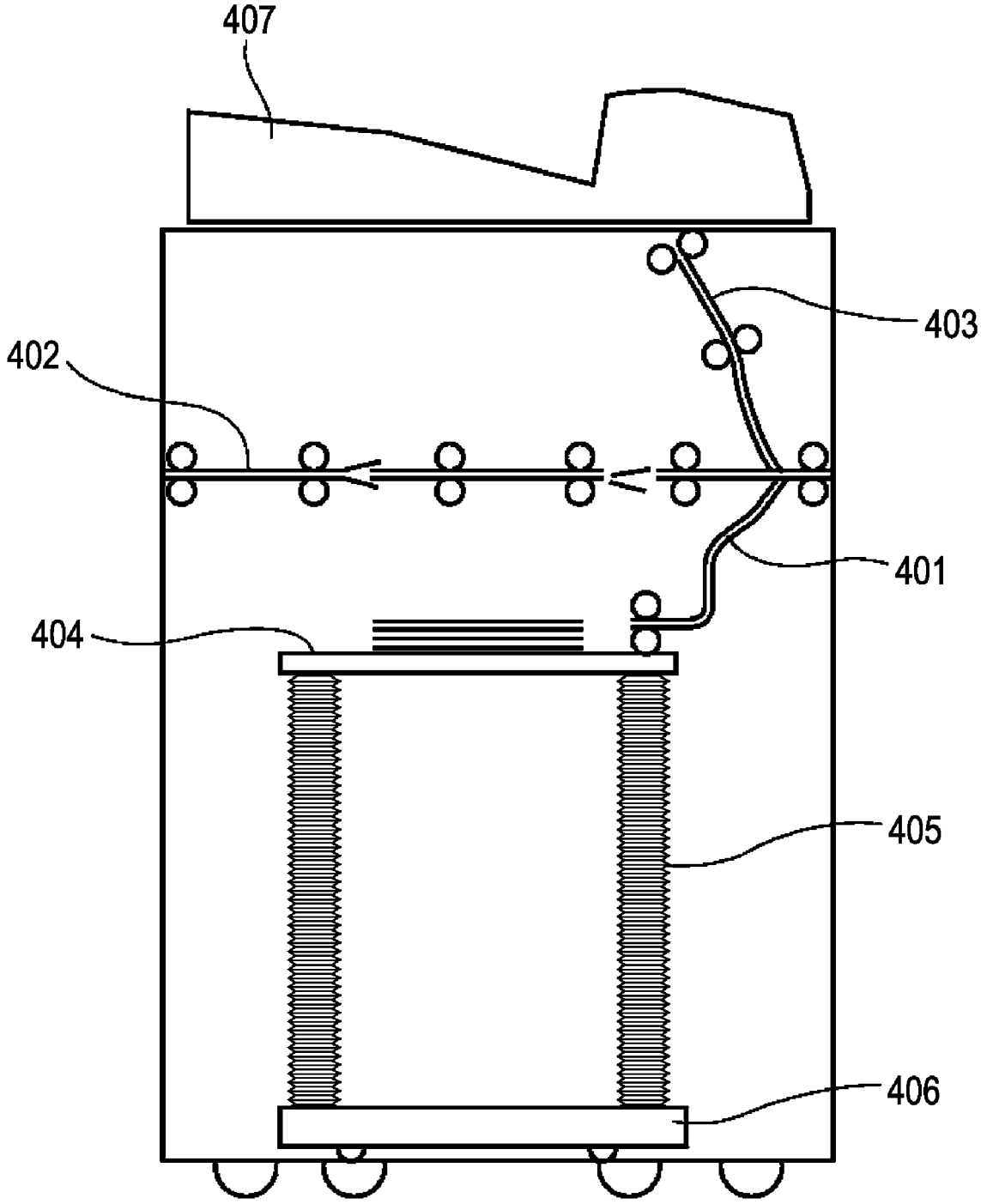
FIG. 4 is a cross-sectional view of a large-capacity stacker which can be connected to the printing apparatus in FIG. 1.

Next, the internal configuration of the sheet processing device 200 which can be connected to the printing apparatus 100 will be described by type thereof with reference to FIGS. 4 and 5. FIG. 4 is a cross-sectional view of the large-capacity stacker 200*a* serving as the sheet processing device 200. The large-capacity stacker 200*a* can sequentially stack the sheets subjected to printing processing and supplied at the printing apparatus 100 until the number of the sheets reach a predetermined number of sheets (the maximum permitted number of sheets). This large-capacity stacker 200*a* conveys the sheets conveyed from the upstream device selectively to three conveying paths. One of the conveying paths is a stack path 401, one is a straight path 402, and the remaining one is a sample tray path 403.

The stack path 401 is a sheet conveying path for conveying sheets to a stack tray 404. The stack tray 404 in FIG. 4 is a stacking unit to be mounted on an extendable stay 405, or the like. A detachable dolly 406 is attached under the extendable stay. Attaching the dolly 406 permits the user to convey sheets in a state of being stacked in the stack tray 404.

Let us say that an execution request for a job arranged to perform sheet stacking processing by employing the large-capacity stacker 200*a* has been performed through the operating unit 204. In this case, the control unit 205 performs control so as to eject the sheets printed at the printing apparatus 100 to the stack tray 404 through the stack path 401 of the large-capacity stacker 200*a* sequentially.

The straight path 402 is a sheet conveying path for conveying sheets relating to a job which does not need sheet stacking processing employing the stack tray 404 to a downstream device passing through the large-capacity stacker 200*a* without stopping.

The sample tray path 403 is a sheet conveying path for ejecting sheets in a sample tray 407. The sample tray 407 is employed in a case of attempting to omit labor hour for taking printed articles out of the stack tray 404 at the time of performing work necessary for confirmation of printed articles, and so forth.

Note that multiple sensors for detecting the sheet conveying state and jamming are provided in the stack path 401, straight path 402, and sample tray path 403. Also, the large-capacity stacker 200*a* includes an unshown CPU, and the CPU informs the control unit 205 of sheet detection information from each of the sheet sensors through signal lines for data communication. The control unit 205 recognizes the sheet conveying state and jamming within the large-capacity stacker 200*a* based on the information informed from the large-capacity stacker 200*a*.

Note that, in a case where another sheet processing device is connected between the large-capacity stacker 200*a* and printing apparatus 100, the information of the sheet sensors of the large-capacity stacker 200*a* is succeeded by into the CPU within the sheet processing device thereof, and informed to the control unit 205.

Figure 5:
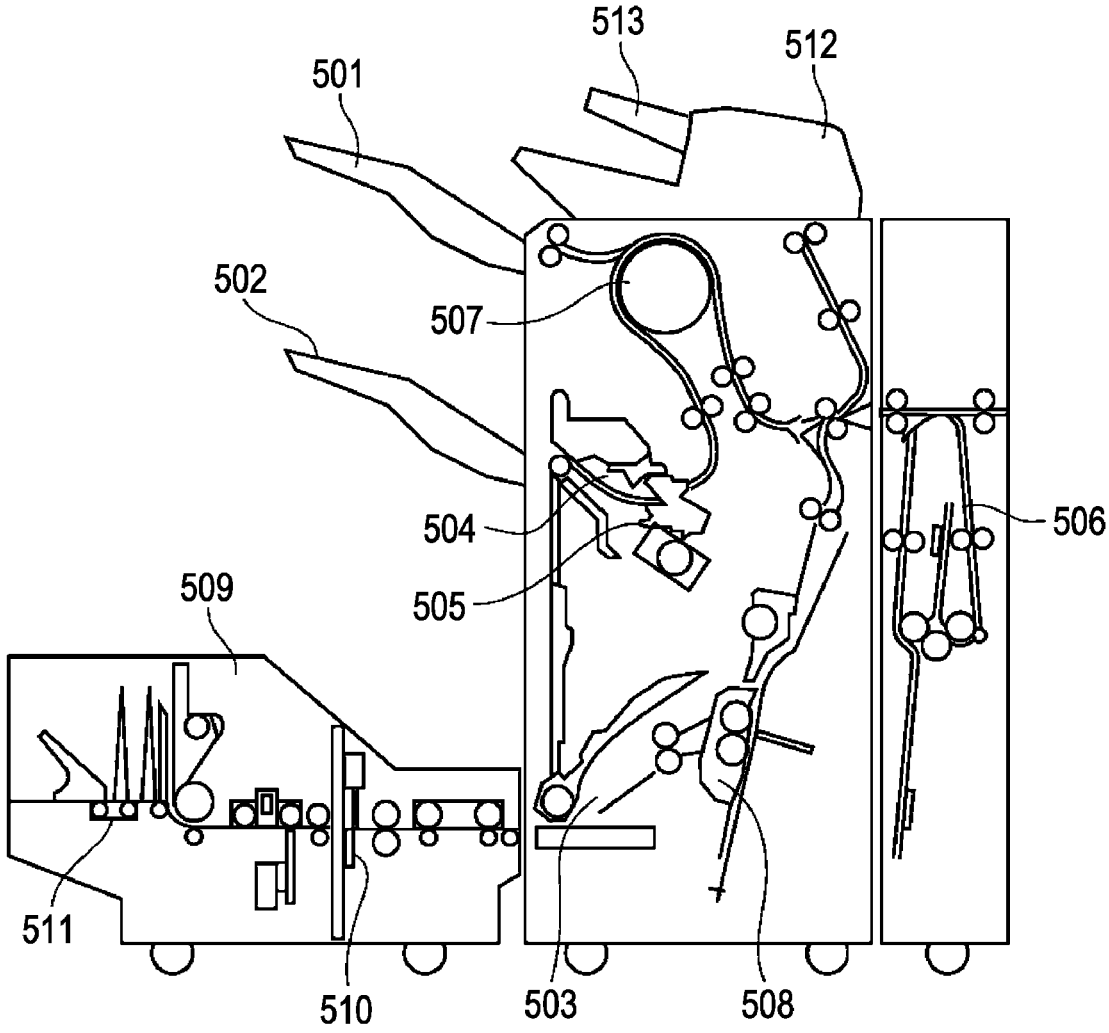
FIG. 5 is a cross-sectional view of a saddle stitch binding unit which can be connected to the printing apparatus in FIG. 1.

FIG. 5 is a cross-sectional view of the saddle-stitch binding unit 200*c* serving as the sheet processing device 200. The saddle-stitch binding unit 200*c* does not include a straight path for conveying sheets to a downstream device. Therefore, in a case where multiple sheet processing devices are connected to the printing apparatus 100, as shown in FIG. 3, the saddle-stitch binding unit 200*c* is connected to the rearmost. Also, as shown in FIG. 5, the saddle-stitch binding unit 200*c* externally includes a sample tray 501, and stack tray 502, and internally includes a booklet tray 503.

In a case of receiving instructions for performing stapling at the saddle-stitch binding unit 200*c*, the control unit 205 sequentially stacks the sheets printed at the printing apparatus 100 in a processing tray 504 within the saddle-stitch binding unit 200*c*. Upon one bundle worth of sheets being stacked in the processing tray 504, the control unit 205 performs stapling processing by a stapler 505. Subsequently, the control unit 205 ejects the stapled sheet bundle from the processing tray 504 to the stack tray 502.

Also, in a case of executing a job wherein it has been instructed to perform Z folding at the saddle-stitch binding unit 200*c*, the control unit 205 subjects the sheets printed at the printing apparatus 100 to Z-letter-like folding processing by a Z folding unit 506. Subsequently, the control unit 205 performs control so as to eject the sheets subjected to the Z folding processing to an ejecting tray such as the stack tray 502, sample tray 501, or the like.

Also, in a case of receiving instructions for performing hole-punching processing at the saddle-stitch binding unit 200*c*, the control unit 205 subjects the sheets printed at the printing apparatus 100 to the hole-punching processing by a puncher 507. Subsequently, the control unit 205 performs control so as to eject the sheets subjected to the hole-punching processing to an ejecting tray such as the stack tray 502, sample tray 501, or the like.

Also, in a case of executing a job wherein it has been instructed to perform saddle-stitch binding processing at the saddle-stitch binding unit 200*c*, the control unit 205 subjects the center portion of a sheet bundle made up of one set worth of multiple sheets to two-place binding by a saddle stitcher 508. Subsequently, the control unit 205 gears the center portion of the sheet bundle with a roller, thereby performing double folding with the center portion of the sheets as reference. Thus, a booklet such as a pamphlet can be created. Thus, a sheet bundle subjected to the saddle-stitch binding processing at the saddle stitcher 508 is conveyed to the booklet tray 503.

Also, in a case of receiving instructions for performing trimming processing as to a job wherein it has been instructed to perform saddle-stitch binding processing, the control unit 205 conveys a sheet bundle subjected to saddle-stitch binding from the booklet tray 503 to a trimmer 509. Subsequently, the control unit 205 trims the sheet bundle conveyed to the trimmer 509 by employing a cutter 510, and holds the sheet bundle at a booklet holder 511. The saddle-stitch binding unit 200*c* in FIG. 5 is also configured so as to subject the sheet bundle subjected to saddle-stitch binding to three-sided trimming.

Note that, in a case where the saddle-stitch binding unit 200*c* does not include the trimmer 509, the sheet bundle bound at the saddle stitcher 508 can be taken out from the booklet tray 503. Also, with the saddle-stitch binding unit 200*c*, a sheet, for example, such as a cover sheet printed beforehand or the like set in an insert tray 513 of an inserter 512 may be appended to sheets conveyed from the printing apparatus 100.

Figure 6:
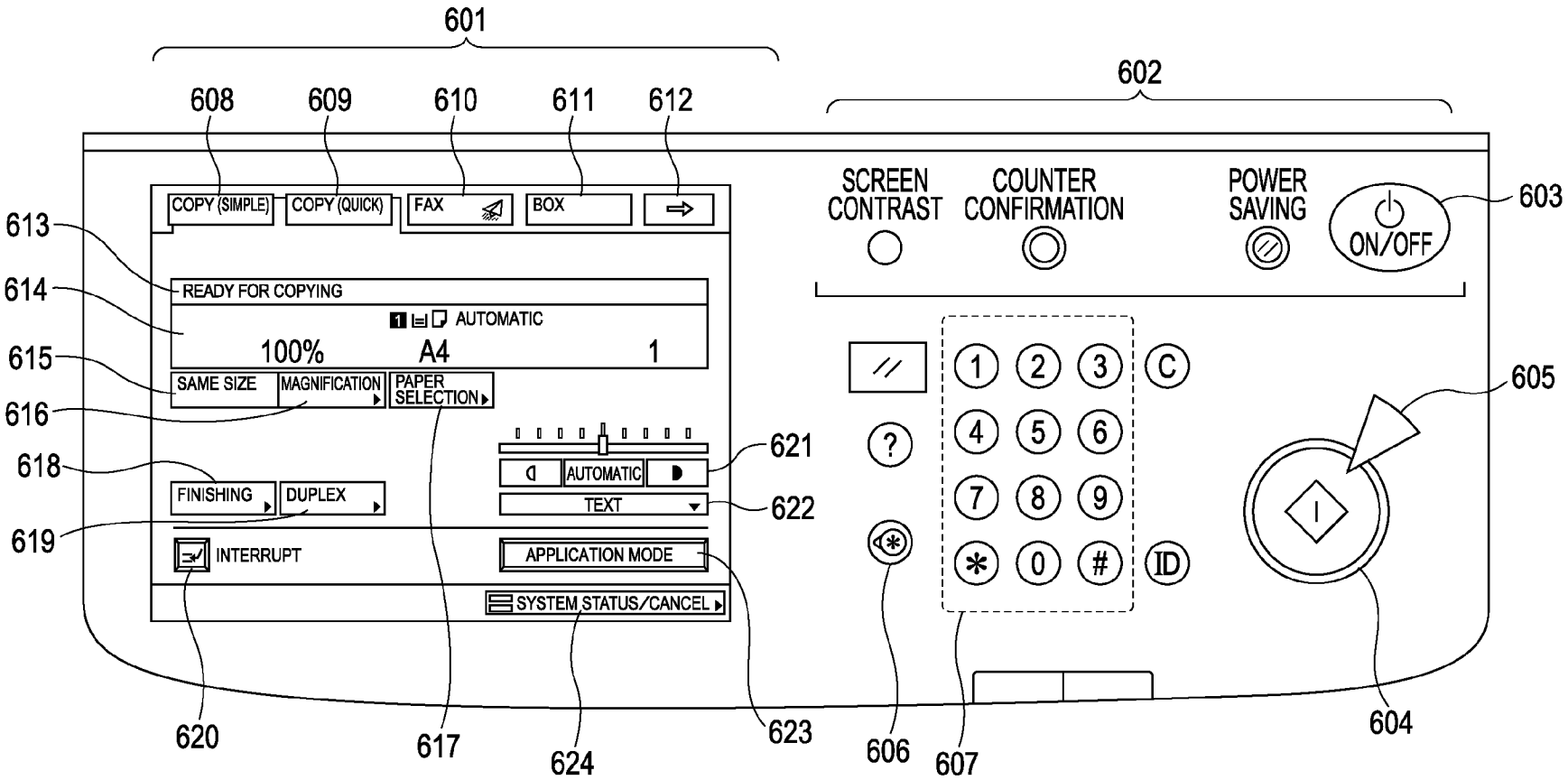
FIG. 6 is a diagram illustrating a configuration example of an operating unit of the printing apparatus in FIG. 1.

Next, the configuration of the operating unit 204 will be described with reference to FIG. 6. As shown in FIG. 6, the operating unit 204 includes a touch panel unit 601, and hard key input unit 602. The touch panel unit 601, which is made up of an LCD (Liquid Crystal Display) and a transparent electrode adhered thereupon, displays various types of setting screens (GUI screens) for receiving instructions from the user.

The hard key input unit 602 includes a power key 603, start key 604, stop key 605, user mode key 606, and numeric keys 607. The start key 604 is employed in a case of causing the printing apparatus 100 to start execution of a transmission job. The user mode key 606 is employed in a case of setting various types of user mode, and according to the operations of the user mode key 606, for example, the GUI screen in FIG. 9 can be displayed. The numeric keys 607 are employed in a case of performing settings of numeric value input such as the number of copies, and so forth.

The control unit 205 controls the printing system 1000 so as to perform various types of processing based on the user's instructions accepted through various types of screens displayed on the touch panel unit 601, and the user's instructions accepted through the key input unit 602.

A "simple copy" tab 608, "quick copy" tab 609, "fax" tab 610, "box" tab 611, and "expansion" tab 612 are displayed on the upper portion of the display region of the touch panel unit 601 as operators for function selection. Upon such a tab being operated, an operating screen (GUI screen) for the function relating to the tab thereof is displayed. Also, the above-mentioned five tabs are always displayed even in a case of displaying the GUI screen relating to any function. Also, a basic GUI screen 600 relating to copy functions (simply copy and quick copy) is displayed on the touch panel unit 601 in FIG. 6.

A status display portion 613, setting information display portion 614, "same size" key 615, "enlarge/reduce" key 616, "paper selection" key 617, "finishing" key 618, "duplex" key 619, and "interrupt" key 620 are displayed on the GUI screen 600. Further, a "density" key 621, "image mode" key 622, "application mode" key 623, and "system monitor" key 624 are also displayed on the GUI screen relating to the copy functions.

Information for informing the user of the operation situation of the printing apparatus 100 is displayed on the status display portion 613 of the GUI screen 600. Information set on the GUI screen relating to the copy function such as enlargement/reduction (same size or the like), paper size (A4 or the like), number of copies (one copy or the like), and so forth is displayed on the setting information display portion 614. The "same size" key 615 is a key for setting enlargement/reduction of 100% (same size). The "enlarge/reduce" key 616 is a key for setting an arbitrary enlargement/reduction rate, for example, such as 126% or the like. The "paper selection" key 617 is a key for setting a paper size relating to specification, such as A4, B5, or the like.

The "finishing" key 618 is a key for performing settings regarding various types of sheet processing performed at the sheet processing device 200 connected to the printing apparatus 100. According to operating the "finishing" key 618, the control unit 205 performs control so as to display the GUI screen in FIG. 7. Description will be made later in detail regarding the GUI screen in FIG. 7.

The "duplex" key 619 is a key for setting a "duplex mode" for performing copy printing on both sides of sheets. The "interrupt" key 620 is a key for setting interruption processing. The "density" key 621 is a key for setting printing density at the time of copy printing. With the "density" key 621, in addition to an "automatic" density mode for the control unit 205 automatically setting appropriate density based on the density and so forth of a document image, the user's desirable arbitrary density can be set.

The "image mode" key 622 is a key for setting the type of an image to be copied, such as text, image, or the like. The "application mode" key 623 is a key for setting various types of application mode. The "system monitor" key 624 is a key for displaying the situation and so forth of the printing system 1000.

The control unit 205 executes printing operation in accordance with various types of printing conditions to be input by employing the GUI screen displayed on the touch panel unit 601 and hard key input unit 602, by the printer unit 203. As for jobs to be set by the operations of the operating unit 204 as printing targets, there are a printing job for immediately printing printed data read by the scanner unit 201, and a printing job relating to a box function for printing printed data stored in the HDD 209 of the printing apparatus 100.

Note that the box function is a function for storing printed data input from the scanner unit 201 or an external device such as the PC 104 or the like in the HDD 209 in a state of being rendered into a bit map. Printed data stored in the HDD 209 can be printed whenever suitable by employing this box function.

In this case, the operating unit 204 is employed to display the printed data which is printed candidates, and select one or multiple pieces of desired printed data from the displayed printed data, and set printing conditions, sheet processing conditions, and so forth, whereby printing can be executed. Note that the printed data stored in the HDD 209 by the box function can be printed any number of times at any time without being eliminated from the HDD 209 even after printing by the printer unit 203 as long as elimination instructions are not received from the operator.

Figure 7:
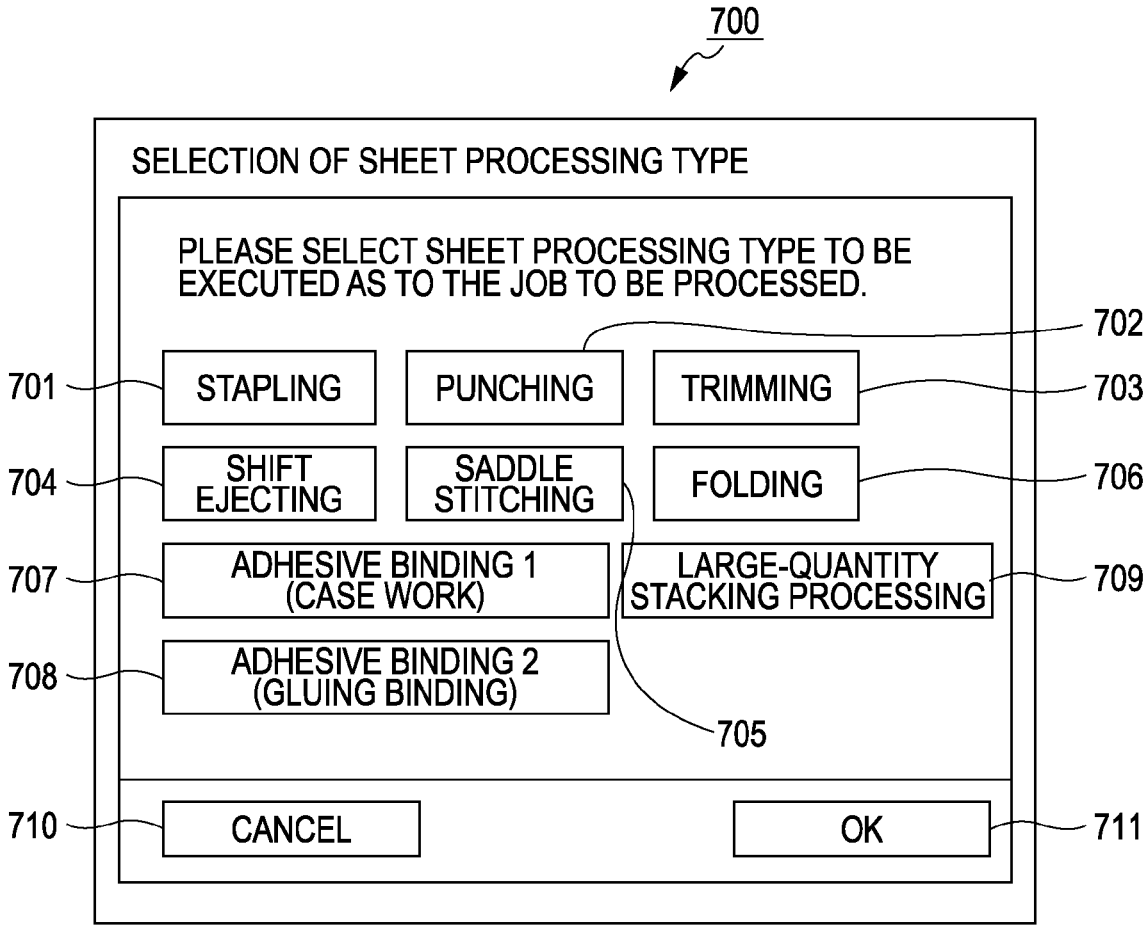
FIG. 7 is a diagram illustrating a GUI screen example for selecting a sheet processing (finishing processing) type.

FIG. 7 exemplifies a GUI screen displayed at the time of the operator operating the "finishing" key 618, and the operator can select the type of sheet processing (finishing processing) on this GUI screen 700. As shown in FIG. 7, a "stapling" key 701, "punching" key 702, "trimming" key 703, "shift ejecting" key 704, "saddle-stitch binding" key 705, and "folding" key 706 are displayed on the GUI screen 700 for selection of type of sheet processing (finishing processing). Further, "adhesive binding (case work)" key 707, "adhesive binding (glue binding)" key 708, "large-quantity stacking processing" key 709, "cancel" key 710, and "OK" key 711 are displayed on the GUI screen 700.

The type of finishing processing selected by such a key operation can be imagined by the name of the key thereof, so description thereof will be omitted here. However, the "large-quantity stacking processing" key 709 will be described later with reference to FIG. 8. In order to perform the type of finishing processing set by employing the GUI screen in FIG. 7, the control unit 205 controls the sheet processing device 200 for executing the finishing processing thereof.

Figure 8:
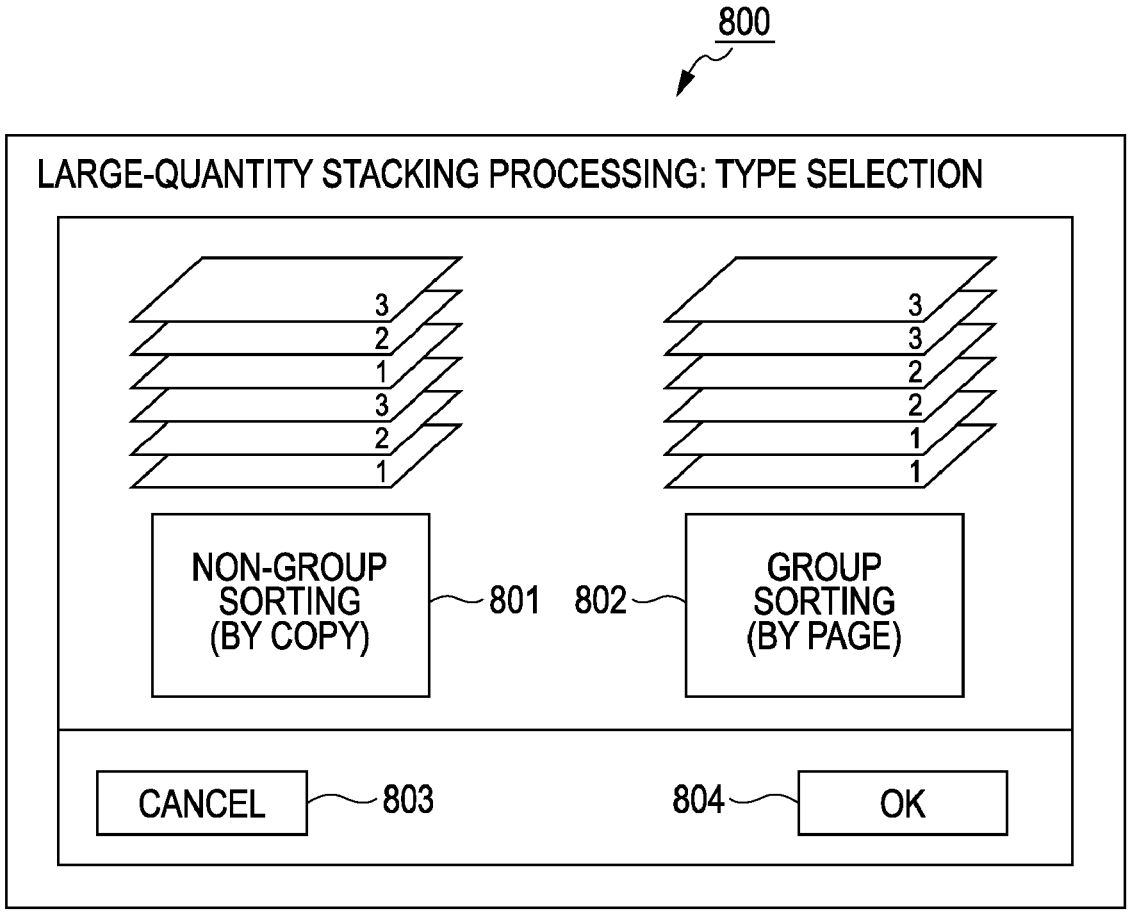
FIG. 8 is a diagram illustrating a GUI screen example for selecting a stacking method in large-quantity stacking processing for sheets.

FIG. 8 exemplifies a GUI screen displayed at the time of operating the "large-quantity stacking processing" key 709 in FIG. 7, and a stack method can be selected on the GUI screen 800. As shown in FIG. 8, a "non-group sorting (by copy)" key 801, "group sorting (by page)" key 802, "cancel" key 803, and "OK" key 804 are displayed on the GUI screen 800 for selecting a stack method. A group sorting method and non-group sorting method which are stack methods in a case of performing large-quantity stacking processing are as follows.

Group Sorting Method and Non-Group Sorting Method

In a case where multiple copies of printed articles (sheets) relating to a document of multiple pages are stacked, i.e., in a case of stacking a massive number of printed articles, there are the following two methods from the perspective of the stacking order of the respective pages.

Figure 9A:
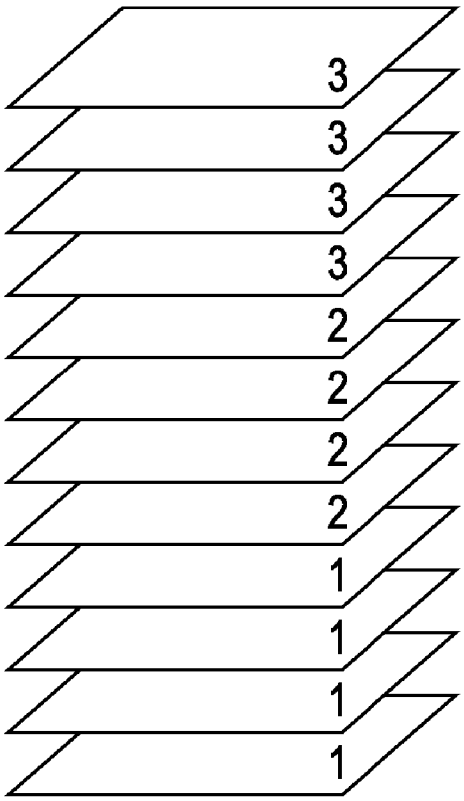
FIG. 9 is a diagram for describing a group sorting method and non-group sorting method which are stacking methods in the case of performing the large-quantity stacking processing.
Figure 9B:
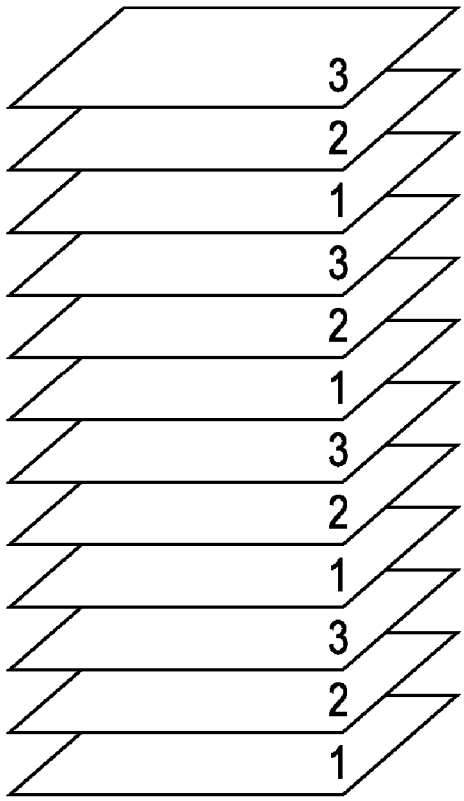

(1) Stacking Employing the Group Sorting Method (2) Stacking Employing the Non-Group Sorting Method Specific examples of these two stack methods will be described based on FIGS. 9A and 9B. FIG. 9A illustrates a case where a document made up of three pages is copied by four copies, and the copies are stacked.

The stack with the group sorting method is the following stack method. Specifically, as shown in FIG. 9A, a method wherein four sheets of the first page of each document are continuously stacked, four sheets of the second page of each document are continuously stacked, and subsequently, four sheets of the third and last page are continuously stacked, is the group sorting method.

Also, the stack employing the non-group sorting method is such as the following stack method. Specifically, as shown in FIG. 9B, the sheets of the first copy, which are the first page, second page, and third page of the first copy of the document, are continuously stacked. Next, the sheets of the second copy which are the first page, second page, and third page of the second copy of the document, are continuously stacked. Similarly, the sheets of the third and last copy are continuously stacked. Thus, a stack method wherein the sheets of all pages of a certain copy are continuously stacked, following which the sheets of all pages of the next copy are continuously stacked, is the non-group sorting method.

Note that with the non-group sorting method, in a case of a document of two pages or more, the same image sheets are not stacked continuously. Accordingly, for example, even in a case where a massive number of sheets such as 5000 copies or the like are stacked, and the stacking height thereof becomes high, the probability that portions where the thickness of toner is thick will continue is low, and accordingly, the probability that stacked sheets will be inclined, or the sides at the time of stacking will become curved or shifted, or stacked sheets will shift and fall from the stacker, is low.

On the other hand, with the group sorting method, in a case of a document of two pages or more, the same content sheets are stacked continuously. Accordingly, in a case where a massive number of sheets, for example, such as 5000 sheets, are stacked with the group sorting method, portions where the thickness of toner is thick continue 5000 times, which causes a great difference in stacking height as to portions where the thickness of toner is thin. Therefore, there is a high probability that stacked sheets will become unstable, or shift and fall from the stacker.

Figure 10:
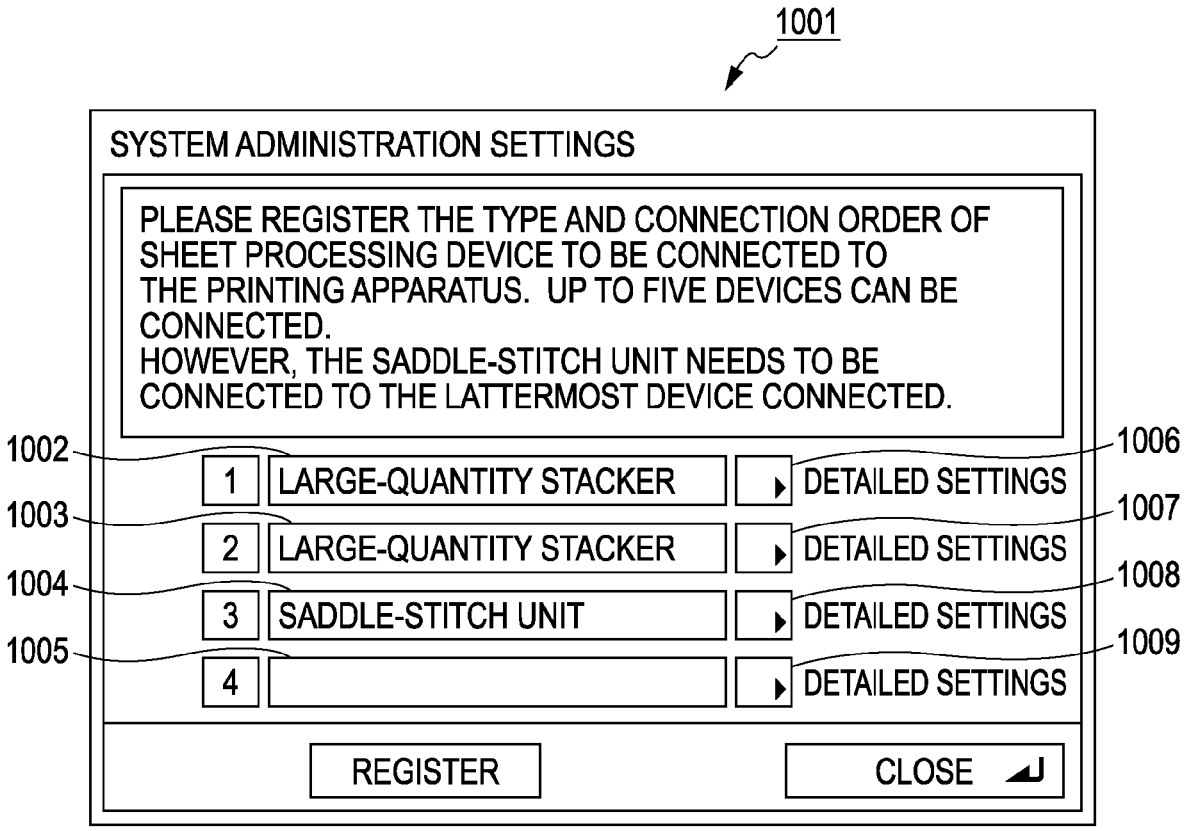
FIG. 10 is a diagram illustrating a GUI screen example for setting a sheet processing apparatus to be connected to the printing apparatus.

FIG. 10 exemplifies a GUI screen displayed at the time of the user mode key 606 in FIG. 6 being operated, and sheet processing devices 200 to be connected to the printing apparatus 100, and the connection order thereof can be set on the GUI screen 1001. FIG. 10 illustrates that a total of three sheet processing devices of a large-quantity stacker, large-quantity stacker, and saddle-stitch binding unit are set. This setting information is held in RAM 208, and the control unit 205 refers to the setting information held in the RAM 208 as appropriate to perform appropriate control as to the printing apparatus 100, and sheet processing devices to be connected thereto.

Note that "detail setting" keys 1006 through 1009 on the right side of input fields 1002 through 1005 are operated respectively, whereby a threshold for performing error processing relating to later-described large-quantity stacking processing, and so forth can be modified or set arbitrarily regarding the corresponding sheet processing device 200. The threshold for performing error processing relating to large-quantity stacking processing mentioned here indicates, specifically, later-described "upper limit number of the same sheets (recommended number of sheets: second management information) X". This recommended number of sheets is registered in the RAM 208 separately from the above-mentioned maximum permitted number of sheets, and managed.

In a case where a connection has been set on the GUI screen 1001 in FIG. 10 wherein the saddle-stitch binding unit 200*c* having no straight path is not connected to the rearmost, the control unit 205 displays an error message to the effect that the setting thereof is invalidated on the touch panel unit 601. In this case, the control unit 205 displays guidance information to the effect that the saddle-stitch binding unit 200*c* has to be connected to the rearmost together.

Note that the above-mentioned function of the operating unit 204 may be implemented, for example, in a user interface relating to an external device such as the PC 103, PC 104, or the like. Thus, an arrangement is made wherein, in a case of operating the printing system 1000 remotely from an external device, a GUI screen relating to the printing system 1000 such as shown in FIG. 11 can be displayed on a display unit of the device thereof.

Figure 11:
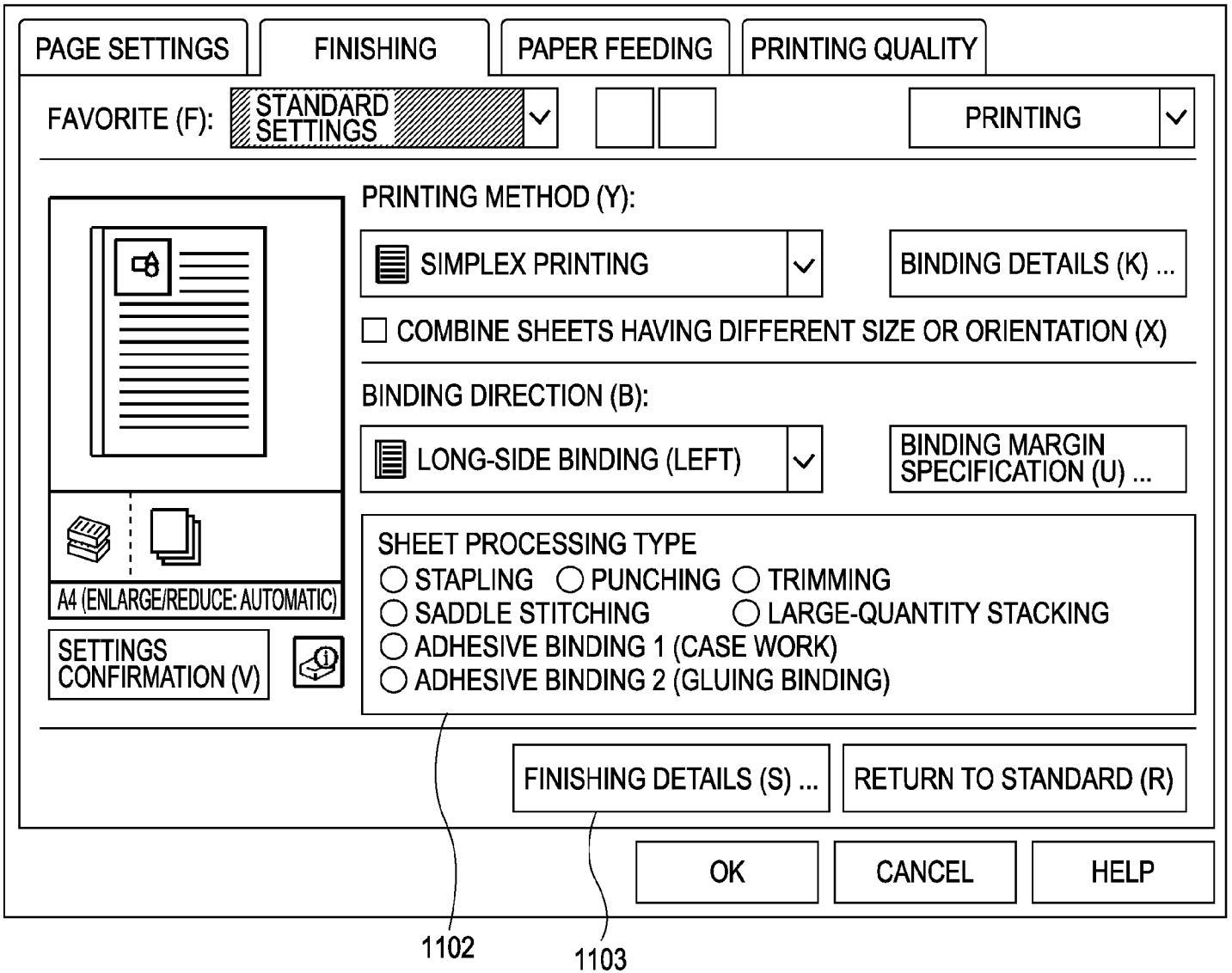
FIG. 11 is a diagram illustrating, in a case where a printing system 1000 is operated remotely from an external device, a GUI screen example displayed on a display unit of the device thereof.

For example, an arrangement is made wherein the GUI screen 1101 in FIG. 11 can be displayed on a display device of the PC 104. In the GUI screen 1101, a setting column 1102 for setting the type of sheet processing is provided. Also, as a key specific to the present embodiment, a "finishing details" key 1103 is displayed. The operator operates this "finishing details" key 1103, whereby the threshold for performing error processing relating to later-described large-quantity stacking processing (upper limit number of the same sheets X) or the like can be modified or set arbitrarily.

Figure 12:
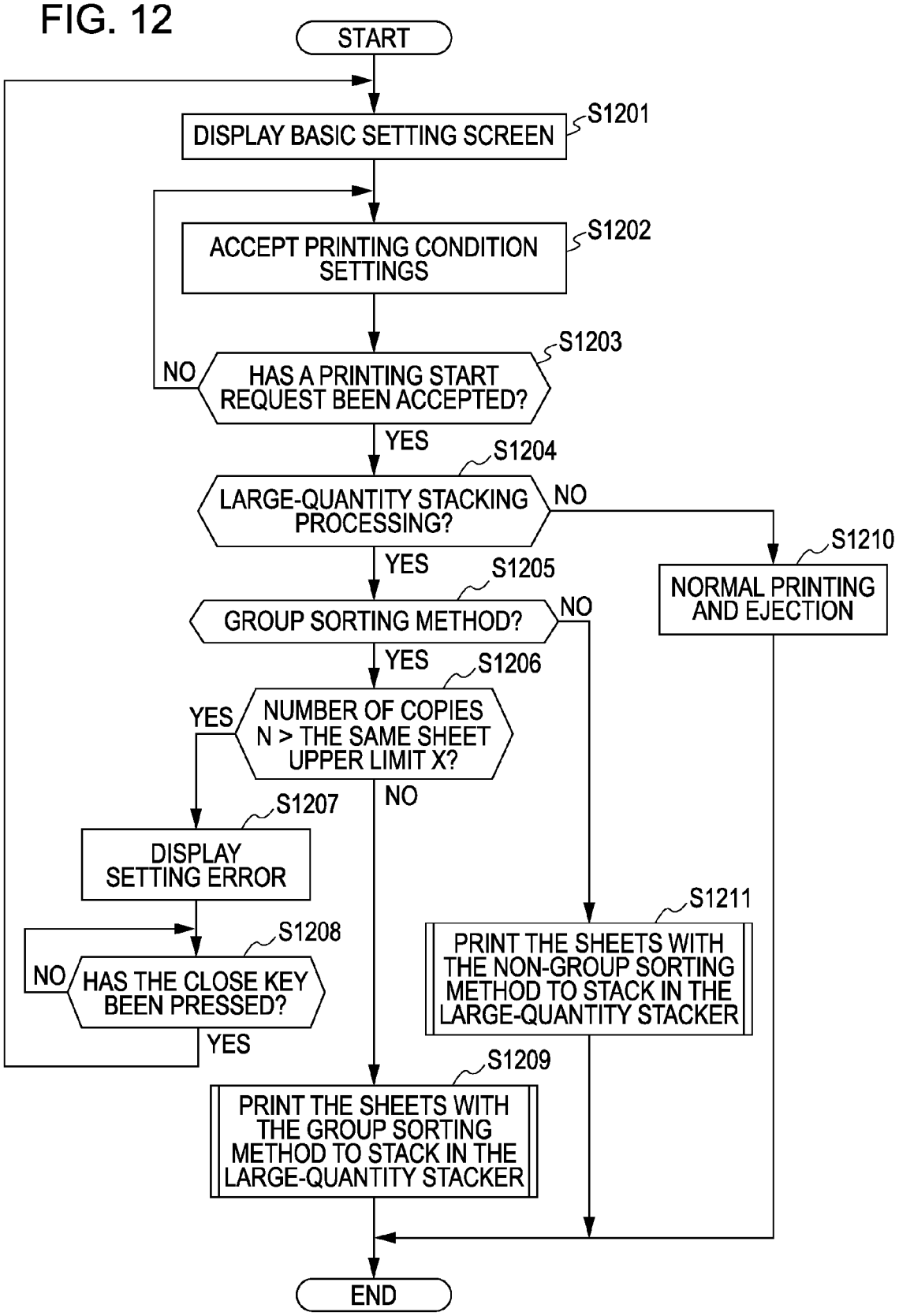
FIG. 12 is a flowchart illustrating the large-quantity stacking processing according to the first embodiment of the present invention.

Next, large-quantity stacking processing specific to the first embodiment will be described based on the flowchart in FIG. 12.

Upon the power key 603 on the operating unit 204 being turned on, the control unit 205 of the printing apparatus 100 displays the basic GUI screen 600 of the printing system 1000 such as shown in FIG. 6 on the touch panel unit 601 (step S1201). Next, the control unit 205 accepts setting operations for various types of printing conditions and sheet processing conditions through the operating unit 204, and sets the accepted setting.

Next, the control unit 205 performs determination whether or not a printing start request for a job to be processed has been performed by determining whether or not a pressing operation of the start key 604 has been performed (step S1203).

In a case where determination is made that a printing start request for a job to be processed has been performed, the control unit 205 determines whether or not "large-quantity stacking processing" has been set in a series of printing conditions set in step S1202 (step S1204). In a case where "large-quantity stacking processing" has not been set, the control unit 205 prints the printed data of the job of which the printing start request has been performed in step S1203 by the printer unit 203, and ejects printed sheets (step S1210: normal printing and ejecting). In this case, the control unit 205 performs printing control and sheet processing control in accordance with the printing conditions and sheet processing conditions set in step S1202.

On the other hand, in a case where "large-quantity stacking processing" has been set, the control unit 205 determines whether or not the stack employing the group sorting method has been set with the series of printing conditions and sheet processing conditions set in step S1202 (step S1205). As a result thereof, in a case where the stack employing the non-group sorting method has been set instead of the stack employing the group sorting, the control unit 205 performs control so as to stack sheets in a large-capacity stacker by employing the non-group sorting method such as shown in FIG. 9B (step S1211). The details of the stacking processing by the non-group sorting method will be described later based on FIG. 16.

On the other hand, in a case where the stack employing the group sorting method has been set, the control unit 205 performs the following determination. Specifically, the control unit 205 determines whether or not the "number of copies (number of total printed copies) N" is greater than the "upper limit number of the same sheets X" (step S1206). Note that the details of this determination processing will be described later.

As a result thereof, in a case where the "number of copies (number of total printed copies) N" is equal to or smaller than the "upper limit number of the same sheets X", the control unit 205 performs control so as to stack sheets in a large-capacity stacker by the group sorting method such as shown in FIG. 9A (step S1209). The details of stacking processing by the group sorting method will be described later based on FIGS. 14 and 15.

On the other hand, in a case where the "number of copies (number of total printed copies) N" is greater than the "upper limit number of the same sheets X", the control unit 205 displays a pop-up error message such as exemplified in FIG. 13 on the touch panel unit 601 (step S1207). A message to the effect that the number of set copies N exceeds the upper limit number of the same sheets X is displayed in a form wherein the upper limit number of the same sheets X is clarified on the error display screen (warning screen) in FIG. 13.

This error display is performed to prevent the stacked sheets from inclining, shifting, or falling, in a case where the number of the same sheets exceeding the upper limit number of the same sheets X are stacked in the stacker in massive numbers, and the sheets are stacked in massive numbers in a state wherein portions where the thickness of toner is thick continue.

Next, upon the "close" key 1301 shown in FIG. 13 being pressed (step S1208), the control unit 205 returns to step S1201, and redisplays the basic GUI screen 600 of the printing system 1000 on the touch panel unit 601.

Accordingly, the user sets the "number of copies (number of total printed copies) N" at or below the "upper limit number of the same sheets X" on the redisplayed basic GUI screen 600, whereby a massive number of sheets can be stacked in the large-stacker 200*a*, 200*b*, or the like by the group sorting method. In this case, the user can set the number of copies N at or below the upper limit number of sheets X thereof while taking the upper limit number of the same sheets X clarified in FIG. 13.

Note that, the sequence advanced from step S1206 to step S1209 means that the control unit 205 confirms whether to have set a setting for stacking more sheets relating to the same image than the upper limit number of the same sheets X continuously before starting the actual printing operation, and subsequently, in a case where there has been set a setting for stacking more sheets relating to the same image than the upper limit number of the same sheets X continuously, the control unit 205 inhibits the actual printing operation.

Also, the upper limit number of the same sheets X may be a default value wherein properties such as the material (paper quality) and thickness of a sheet are not taken into consideration, or may be a default value wherein the relevant properties are taken into consideration. Also, these default values may automatically be modified by the control unit 205 according to the surrounding environment (temperature, humidity, etc.) of the sheet processing device 200. Further, the user may modify or set the default upper limit number of the same sheets X arbitrarily. Also, the user may always set the upper limit number of the same sheets X. In a case where the user sets the upper limit number of the same sheets X, it is desirable to display the upper limit number of the same sheets X which is a target for preventing sheet bundles stacked in massive numbers from inclining, shifting, or falling, on the touch panel unit 601.

Figure 14:
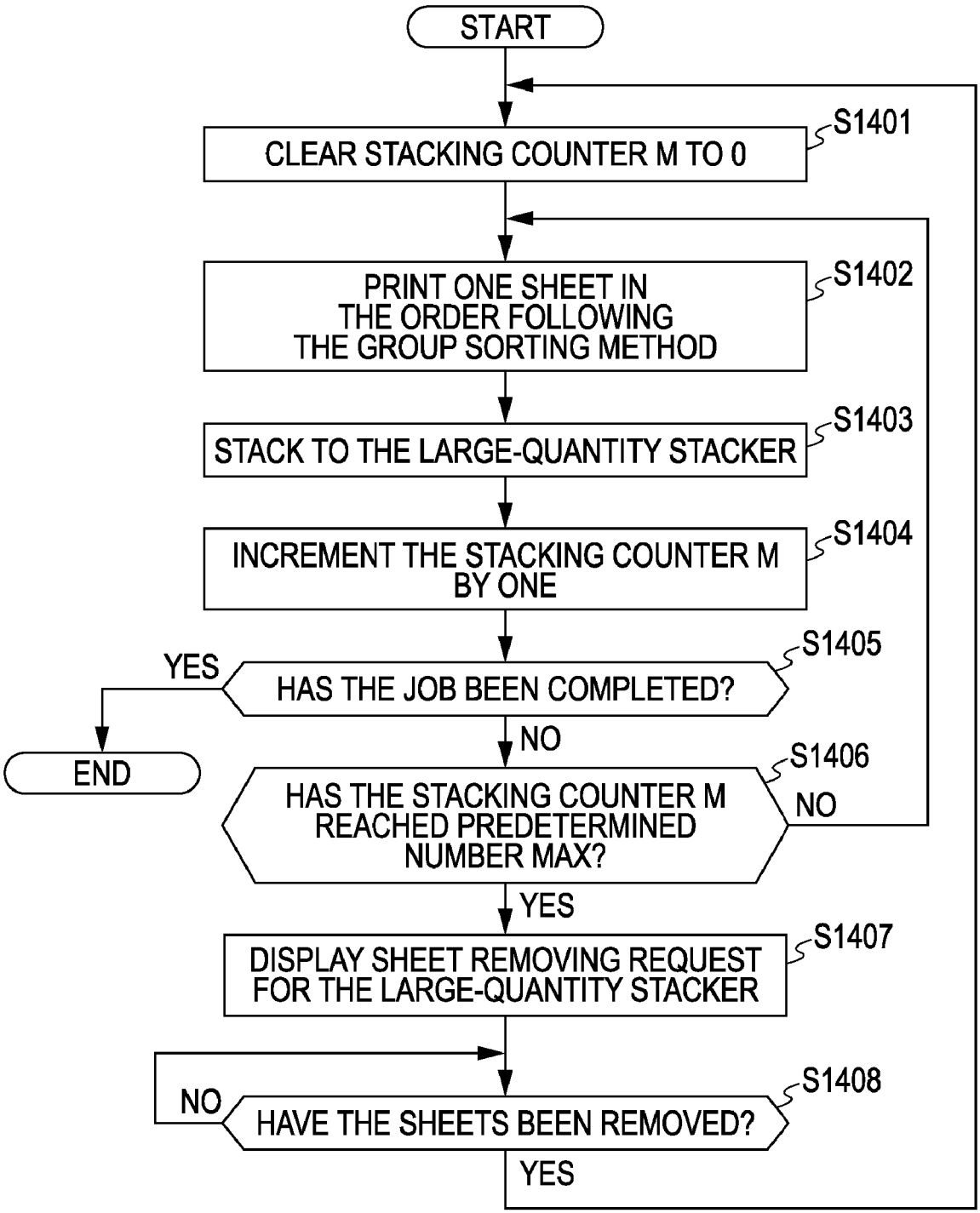
FIG. 14 is a flowchart illustrating the details of the large-quantity stacking processing with the group sorting method in step S1209 in FIG. 12.

Next, the large-quantity stacking processing by the group sorting method in step S1209 in FIG. 12 will be described in detail based on the flowchart in FIG. 14.

The control unit 205 clears the stacking counter M to zero (step S1401). Next, the control unit 205 causes the printing apparatus 100 to execute printing processing as to the next one sheet in the sequence following the group sorting method (step S1402). Next, the control unit 205 passes the sheet subjected to the printing processing through the point A, or points A and B in FIG. 3, and conveys this to the inner portion of the large-capacity stacker 200*a* or 200*b* specified as the sheet processing condition.

Subsequently, the control unit 205 executes the stacking processing of the job, i.e., the large-quantity stacking processing employing the group sorting method by the large-capacity stacker 200*a* or 200*b* (step S1403). Subsequently, the control unit 205 holds the sheet subjected to the large-quantity stacking processing by the large-capacity stacker 200*a* or 200*b* at an ejecting destination X1 or Y1 within the large-capacity stacker 200*a* or 200*b* without conveying this to another device (e.g., a downstream sheet processing device).

Next, the control unit 205 increments the stacking counter M by "1" (step S1404). Subsequently, the control unit 205 determines whether or not all of the processing relating to the job has been completed (step S1405). In a case where all of the processing has not been completed, the control unit 205 determines whether or not the stacking counter M has reached the maximum value (step S1406). As a result thereof, in a case where the stacking counter M has not reached the maximum value, the control unit 205 returns to step S1402. Note that the maximum value mentioned here means the maximum number of stacking sheets (the maximum permitted number of sheets: first management information) which a stacking unit such as a large-capacity stacker or the like can stack.

On the other hand, in a case where determination is made that the stacking counter M has reached the maximum value, the control unit 205 temporarily stops the printing operation, and displays the pop-up error message in FIG. 15 on the touch panel unit 601 (step S1407). The content of the error display in FIG. 15 is that the large-capacity stacker 200*a* or 200*b* has fully been stacked, so the user is guided to remove the sheets stacked fully in the large-capacity stacker 200*a* or 200*b* from the large-capacity stacker 200*a* or 200*b*. Next, the control unit 205 sets it as an assumption to remove the sheets stacked fully in the large-capacity stacker 200*a* or 200*b* (step S1408), and returns to step S1401. The removal of the sheets can be detected by a stacking sensor (not shown) provided in the large-capacity stacker 200*a* or 200*b*.

Figure 16:
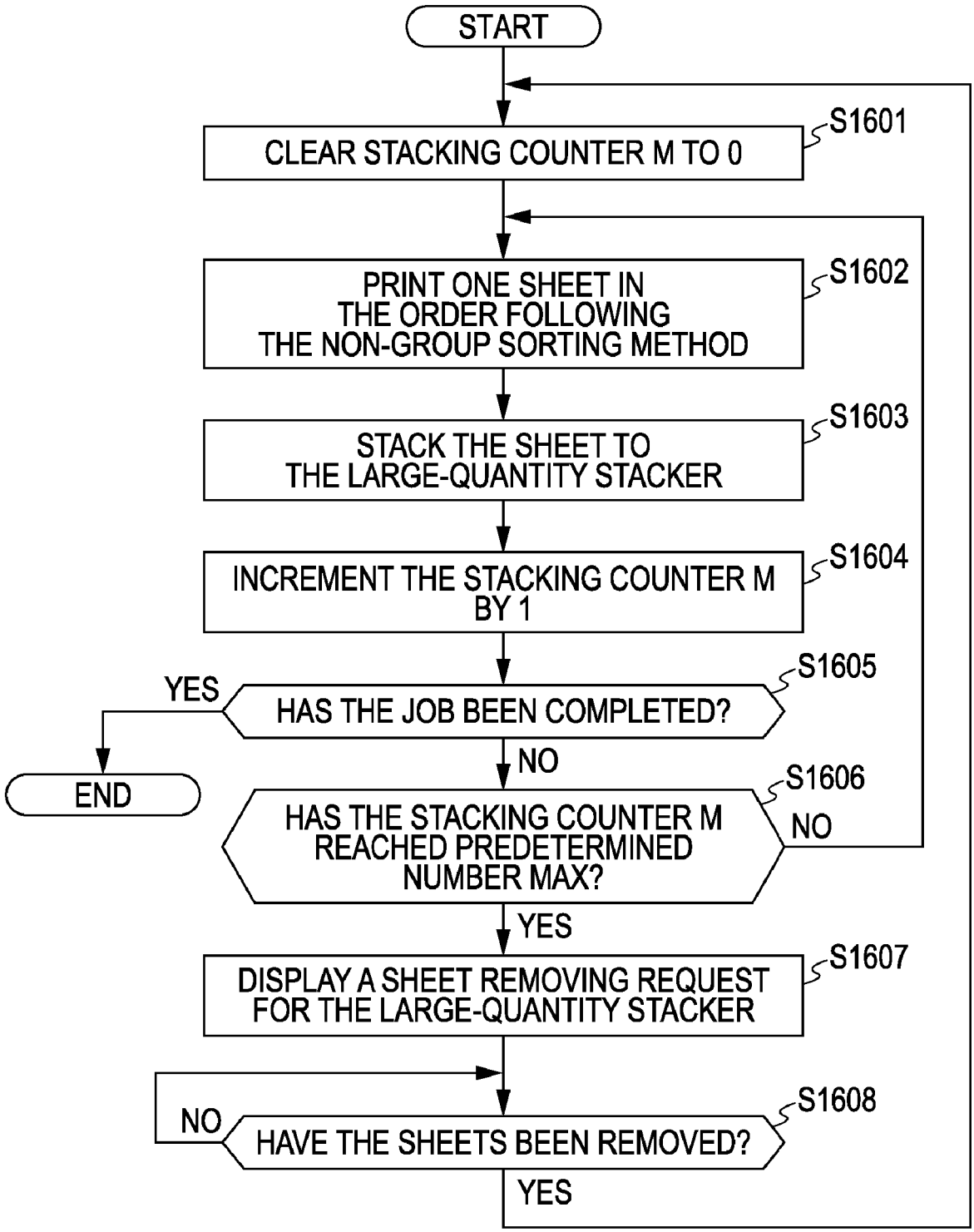
FIG. 16 is a flowchart illustrating the details of the large-quantity stacking processing with the non-group sorting method in step S1211 in FIG. 12.

Next, the large-quantity stacking processing by the non-group sorting method in step S1211 in FIG. 12 will be described in detail based on the flowchart in FIG. 16.

The control unit 205 clears the stacking counter M to zero (step S1601). Next, the control unit 205 causes the printing apparatus 100 to execute printing processing as to the next one sheet in the sequence following the non-group sorting method (step S1602). Next, the control unit 205 passes the sheet subjected to the printing processing through the point A, or points A and B, and conveys this to the inner portion of the large-capacity stacker 200*a* or 200*b* specified as the sheet processing condition.

Subsequently, the control unit 205 executes the stacking processing of the job, i.e., the large-quantity stacking processing employing the non-group sorting method by the large-capacity stacker 200*a* or 200*b* (step S1603). Subsequently, the control unit 205 holds the sheet subjected to the large-quantity stacking processing by the large-capacity stacker 200*a* or 200*b* at the ejecting destination X1 or Y1 within the large-capacity stacker 200*a* or 200*b* without conveying this to another device (e.g., a downstream sheet processing device).

Next, the control unit 205 increments the stacking counter M by "1" (step S1604). Subsequently, the control unit 205 determines whether or not all of the processing relating to the job has been completed (step S1605). In a case where all of the processing has not been completed, the control unit 205 determines whether or not the stacking counter M has reached the maximum value (step S1606). As a result thereof, in a case where the stacking counter M has not reached the maximum value, the control unit 205 returns to step S1602.

On the other hand, in a case where determination is made that the stacking counter M has reached the maximum value, the control unit 205 temporarily stops the printing operation, and displays the pop-up error message in FIG. 15 on the touch panel unit 601 (step S1607). The content of the error display in FIG. 15 is that the large-capacity stacker 200*a* or 200*b* has fully been stacked, so the user is guided to remove the sheets stacked fully in the large-capacity stacker 200*a* or 200*b* from the large-capacity stacker 200*a* or 200*b*.

Next, the control unit 205 sets it as an assumption to remove the sheets stacked fully in the large-capacity stacker 200*a* or 200*b* (step S1608), and returns to step S1601. The removal of the sheets can be detected by the stacking sensor (not shown) provided in the large-capacity stacker 200*a* or 200*b*.

Here, there is a relation of "the maximum value≧the upper limit number of the same sheets X" between the above-mentioned maximum value and the upper limit number of the same sheets X, such as the maximum value=5000 sheets, and the upper limit number of the same sheets X=4000 sheets.

This relation means that, up to the maximum number of sheets can be stacked as the stacking capacity of the large-capacity stackers 200*a* and 200*b*, but in a case of continuously stacking sheets on which the same image is printed, an unstable stacked state occurs at the maximum value or below the upper limit number of the same sheets X. Examples of this unstable stacked state include the sheets relating to stacking becoming inclined, the sides thereof at the time of stacking becoming curved, or the sheets shifting, or shifting and falling.

As described above, with the first embodiment, the control unit 205 confirms whether to have set a setting for stacking more sheets relating to the same image than the upper limit number of the same sheets X continuously before starting the actual printing operation, and subsequently, in a case where there has been set a setting for stacking more sheets relating to the same image than the upper limit number of the same sheets X continuously, the control unit 205 inhibits the actual printing operation.

Accordingly, a massive number of sheets, on which an image is printed wherein the disposed amount of color material is great on the same region is printed, are continuously stacked in the same ejecting destination, whereby a problem such that the sheets incline, shift, or the like can be prevented to a great degree.

Second Embodiment

With the first embodiment, the control unit 205 the control unit 205 confirms whether to have set a setting for stacking more sheets relating to the same image than the upper limit number of the same sheets X continuously before starting the actual printing operation, and subsequently, in a case where there has been set a setting for stacking more sheets relating to the same image than the upper limit number of the same sheets X continuously, the control unit 205 inhibits the actual printing operation.

On the other hand, with the second embodiment, the actual printing operation and large-quantity stacking operation are started without confirming whether to have set a setting for stacking more sheets relating to the same image than the upper limit number of the same sheets X continuously. Subsequently, when the number of stacked sheets reaches the upper limit number of the same sheets X during a process wherein sheets relating to the same image are stacked, the printing operation and large-quantity stacking operation are temporarily stopped (interrupted).

Thus, with the second embodiment, printing operation is started regardless of any printing condition and any sheet stacking condition being set. Accordingly, for example, even in a case where the user leaves the installation location of the printing system immediately after ending the setting operations due to being busy, the user can rapidly obtain mass-printed articles.

Note that with the present second embodiment and later-described third embodiment, a setting for printing the same image continuously (e.g., setting for employing the group sorting method such as the first embodiment) actually starts the printing processing of a printing job performed by the user through the operating unit. Subsequently, this actually started printing processing counts the number of ejected sheets of the printing job.

Also, as for a configuration employed for counting the number of ejected sheets, for example, a sensor (not shown) for counting the number of sheets actually conveyed to the inner portion of the sheet processing device 200 from the printing apparatus 100, is provided in the vicinity of the ejecting roller 310. The control unit 205 counts the number of actually printed sheets based on the information from this sensor. Let us say that such a configuration is employed for the second and third embodiments, but this is an exemplified configuration, and accordingly, methods other than this may be employed. In other words, control for restricting the number of sheets to be stacked in one stacker may be executed at timing (during printing) after starting printing instead of being executed before starting printing such as the first embodiment.

Figure 17:
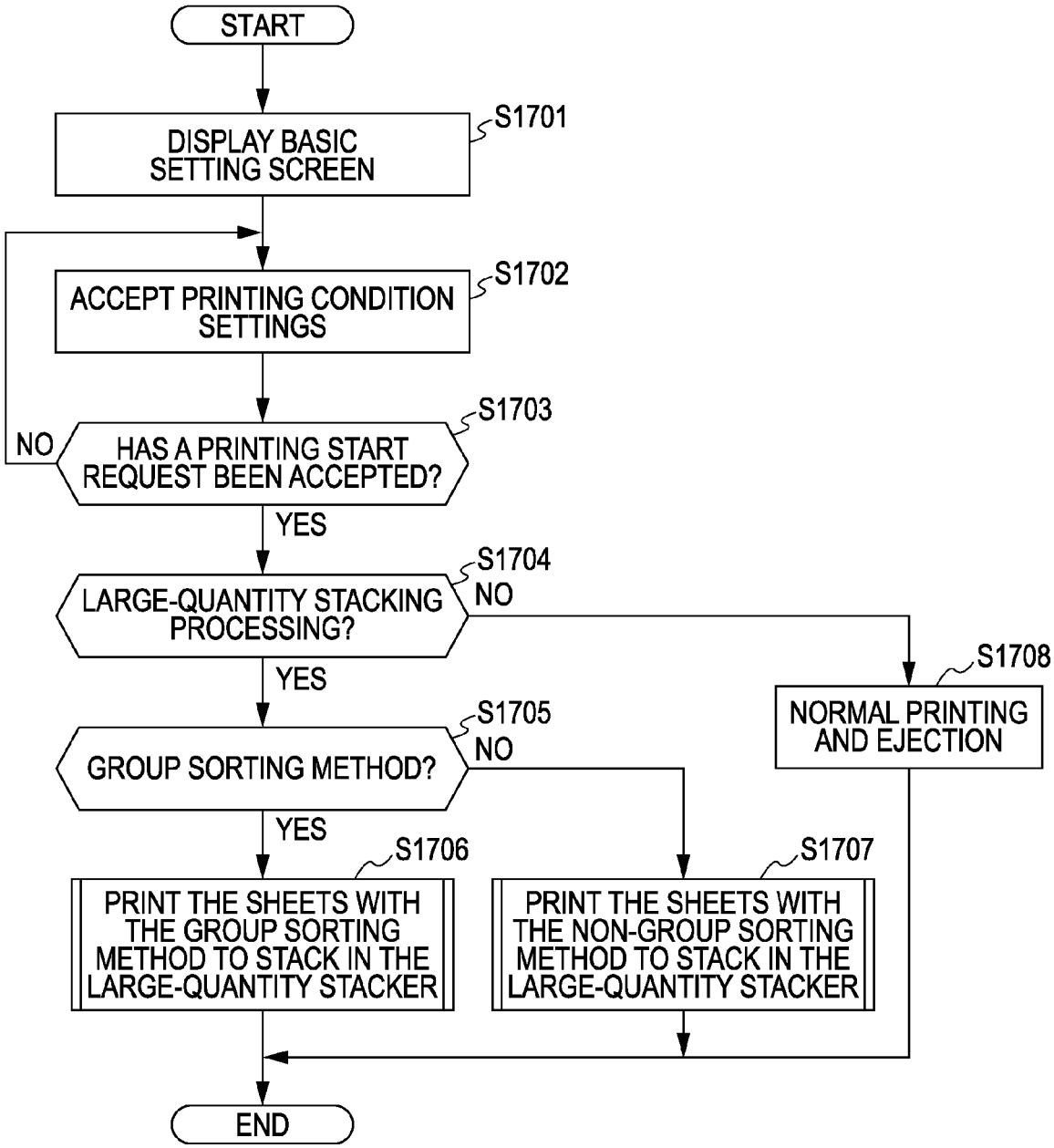
FIG. 17 is a flowchart illustrating large-quantity stacking processing according to a second embodiment of the present invention.

Next, the actual printing operation of the second embodiment will be described. With the second embodiment, FIG. 12 in the first embodiment is equivalent to FIG. 17, and FIG. 14 is equivalent to FIG. 18.

Accordingly, first, the flowchart in FIG. 17 will be described. Upon the power key 603 of the operating unit 204 being turned to on, the control unit 205 displays the basic GUI screen 600 of the printing system 1000 such as shown in FIG. 6 (step S1701). Next, the control unit 205 accepts various types of printing conditions and sheet processing conditions by the operating unit 204, and sets these (step S1702).

Next, the control unit 205 performs determination whether or not a printing start request for a job to be processed has been performed by determining whether or not a pressing operation of the start key 604 has been performed (step S1703).

In a case where determination is made that a printing start request for a job to be processed has been performed, the control unit 205 determines whether or not "large-quantity stacking processing" has been set by the operation of the "large-quantity stacking processing" key 709 in a series of printing conditions (including sheet processing conditions) set in step S1702 (step S1704).

In a case where "large-quantity stacking processing" has not been set, the control unit 205 prints the printed data of the job of which the printing start request has been performed in step S1703 by the printer unit 203, and ejects printed sheets (step S1708) normal printing and ejecting). In this case, the control unit 205 performs printing control and sheet processing control in accordance with the printing conditions and sheet processing conditions set in step S1702.

On the other hand, in a case where "large-quantity stacking processing" has been set, the control unit 205 determines whether or not the stack employing the group sorting method has been set with the series of printing conditions and sheet processing conditions set in step S1702 (step S1705). As a result thereof, in a case where the stack employing the non-group sorting method has been set instead of the stack employing the group sorting, the control unit 205 performs control so as to stack sheets in a large-capacity stacker by employing the non-group sorting method such as shown in FIG. 9B (step S1707).

On the other hand, in a case where the stack employing the group sorting method has been set, the control unit 205 performs control so as to stack the sheets in a large-capacity stacker by employing the group sorting method such as shown in FIG. 9A (step S1706).

Next, the large-quantity stacking processing by the group sorting method in step S1706 in FIG. 17 will be described in detail with reference to the flowchart in FIG. 18.

The control unit 205 clears the stacking counter M and same continuous counter L to zero (step S1801).

Next, the control unit 205 causes the printing apparatus 100 to execute printing processing as to the next one sheet in the sequence following the group sorting method (step S1802). Next, the control unit 205 passes the sheet subjected to the printing processing through the point A, or points A and B in FIG. 3, and conveys this to the inner portion of the large-capacity stacker 200*a* or 200*b* specified as the sheet processing condition.

Subsequently, the control unit 205 executes the stacking processing of the job, i.e., the large-quantity stacking processing employing the group sorting method by the large-capacity stacker 200*a* or 200*b* (step S1803). Subsequently, the control unit 205 holds the sheet subjected to the large-quantity stacking processing by the large-capacity stacker 200*a* or 200*b* at an ejecting destination X1 or Y1 within the large-capacity stacker 200*a* or 200*b* without conveying this to another device (e.g., a downstream sheet processing device).

Next, the control unit 205 increments the stacking counter M by "1" (step S1804). Subsequently, the control unit 205 determines whether or not all of the processing relating to the job has been completed (step S1805). In a case where all of the processing has not been completed, the control unit 205 determines whether or not the sheet stacked in the large-capacity stacker 200*a* or 200*b* is a sheet on which the same image as the sheet stacked most recently is printed (step S1806).

As a result thereof, in a case of a sheet on which the same image as the sheet most recently is printed, the control unit 205 increments the same continuous counter L by "1" (step S1807). Subsequently, the control unit 205 determines whether or not the same continuous counter L has reached the upper limit number of the same sheets X (step S1808). As a result thereof, in a case where the same continuous counter L has reached the upper limit number of the same sheets X, the control unit 205 proceeds to step S1811.

On the other hand, in a case where the same continuous counter L has not reached the upper limit number of the same sheets X, the control unit 205 determines whether or not the stacking counter M has reached the maximum value (S1810). As a result thereof, in a case where the stacking counter M has reached the maximum value, the control unit 205 returns to step S1802, and in a case where the stacking counter M has not reached the maximum value, the control unit 205 proceeds to step S1811.

In a case wherein determination is made in step S1806 that the sheet stacked in the large-capacity stacker 200*a* or 200*b* is not a sheet on which the same image as the sheet stacked most recently is printed, the control unit 205 sets the same continuous counter L to "1" (step S1809). Subsequently, the control unit 205 proceeds to step S1810, and determines whether or not the same continuous counter L has reached the upper limit number of the same sheets X.

In step S1811, the control unit 205 temporarily stops the printing operation, and displays the pop-up warning display in FIG. 19 on the touch panel unit 601. Next, under the condition that the sheets fully stacked in the large-capacity stacker 200*a* or 200*b* have been removed, (step S1812), the control unit 205 returns to step S1801. The removal of the sheets can be detected by the stacking sensor (not shown) provided in the large-capacity stacker 200*a* or 200*b*.

Thus, with the second embodiment, printing operation and large-quantity stacking operation are actually performed, and when the number of continuous stacked sheets relating to the same image printing reaches the upper limit number of the same sheets X, the printing operation is stopped, and the user is guided to remove the sheets in the large-capacity stacker.

In other words, actual printing operation and large-quantity stacking operation are performed without confirming whether or not a setting for continuously stacking more sheets than the upper limit number of the same sheets X in one stacking stacker has been performed before starting the actual printing operation. Subsequently, when more sheets than the upper limit number of the same sheets X are stacked in one stacking stacker continuously, the printing operation is stopped.

Accordingly, a problem that massive numbers of sheets on which an image is printed wherein the disposed amount of color material is great on the same region is printed, are continuously stacked in the same ejecting destination, and the sheets incline, shift, or shift and fall, the sides curve, or the like, can be prevented to a great degree.

Stacking Examples by Each Stacking Method with the Second Embodiment

Now, specific examples of stacking results in a case of such operation has been performed will be described based on FIGS. 20 through 22. For example, let us say that with the capability of the large-capacity stacker, the upper limit number of stacked sheets (the maximum value) is 5000 sheets, and the upper limit number of the same sheets stacked continuously (the upper limit number of the same sheets X) is 4000 sheets. That is to say, up to the maximum 5000 sheets can be stacked, but in a case of continuously stacking sheets on which the same image is printed, stacking becomes an unstable state when the number of sheets exceeds 4000 sheets.

Now, let us say that 7000 copies of a document made up of two pages have been printed by simplex printing, and have been stacked. In this case, an arrangement is made wherein the number of copies for two page worth of two sheets subjected to simplex printing is 7000, so a total of 14000 sheets are stacked in the stacker by being divided into several times.

Figure 20:
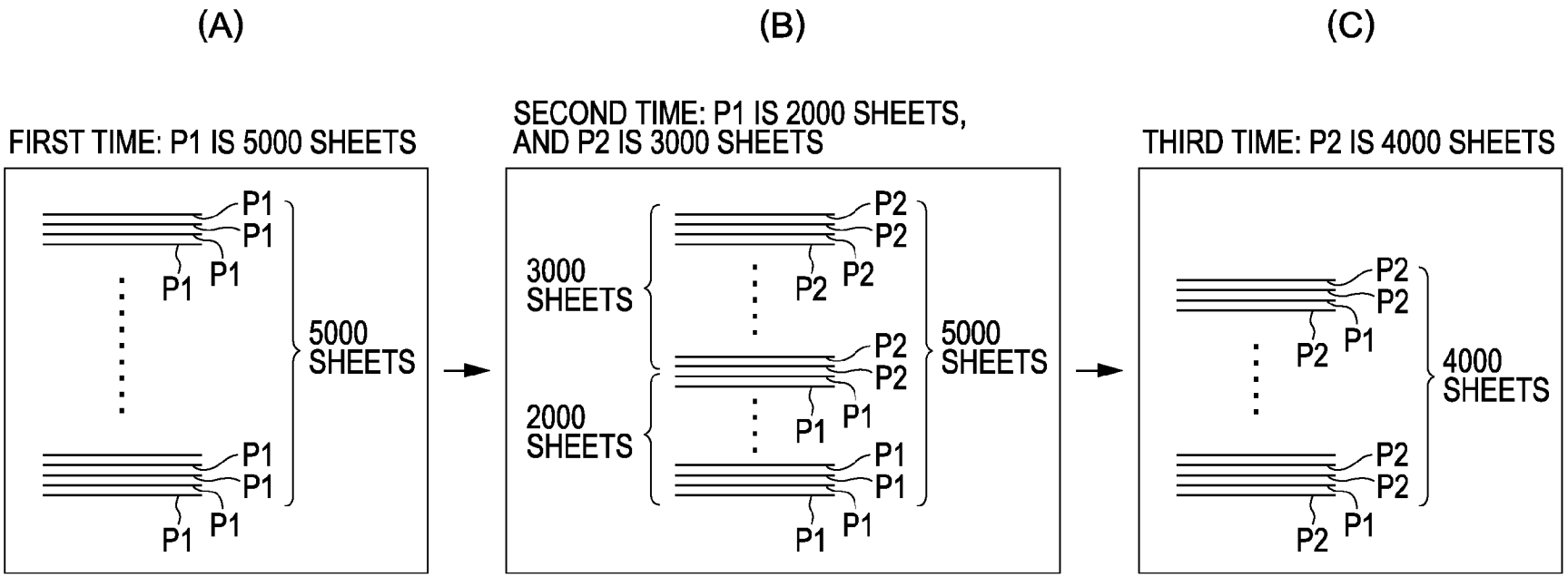
FIG. 20 is a stacking example with the group sorting method (in the case of not applying the present invention).

(A), (B), and (C) in FIG. 20 illustrate a stacking example by the group sorting method. This stacking example is an example wherein the present invention has not been applied, so the upper limit number of the same sheets stacked continuously (the upper limit number of the same sheets X) is not taken into consideration at all.

In a case where sheets are stacked in a certain stacker by the group sorting method, first, as shown in (A) in FIG. 20, sheets relating to the first page (P1) are stacked continuously by 5000 sheets worth of the upper limit number of stacked sheets (the maximum value) (a first time has been completed). Here, 5000 sheets are the upper limit number of stackable sheets, so the control unit 205 temporarily stops stacking on this stacker at the time of 5000 sheets which is the upper limit number of stacked sheets being stacked.

Upon the user removing the sheets, the remaining 2000 sheets of the 7000 copies of the P1 are stacked continuously, and subsequently, sheets relating to the second page (P2) are stacked in this stacker continuously by 3000 sheets (a second time has been completed: (B) in FIG. 20).

At the time of a total of 5000 sheets (the upper limit number of stacked sheets) being thus stacked, stacking to the stacker thereof is stopped temporarily, so upon the user removing the sheets, the remaining 4000 sheets of P2 are stacked in this stacker (a third time has been completed: (C) in FIG. 20).

Thus, the 14000 sheets have been stacked in the one stacker by being divided into three times. Here, with the first stacking, the P1 has been stacked continuously by 5000 sheets. That is to say, more of the sheets on which the same image is printed than the 4000 sheets serving as the upper limit number of the same sheets X have been stacked, which may cause an unstable stacked state (in a conventional case).

Figure 21:
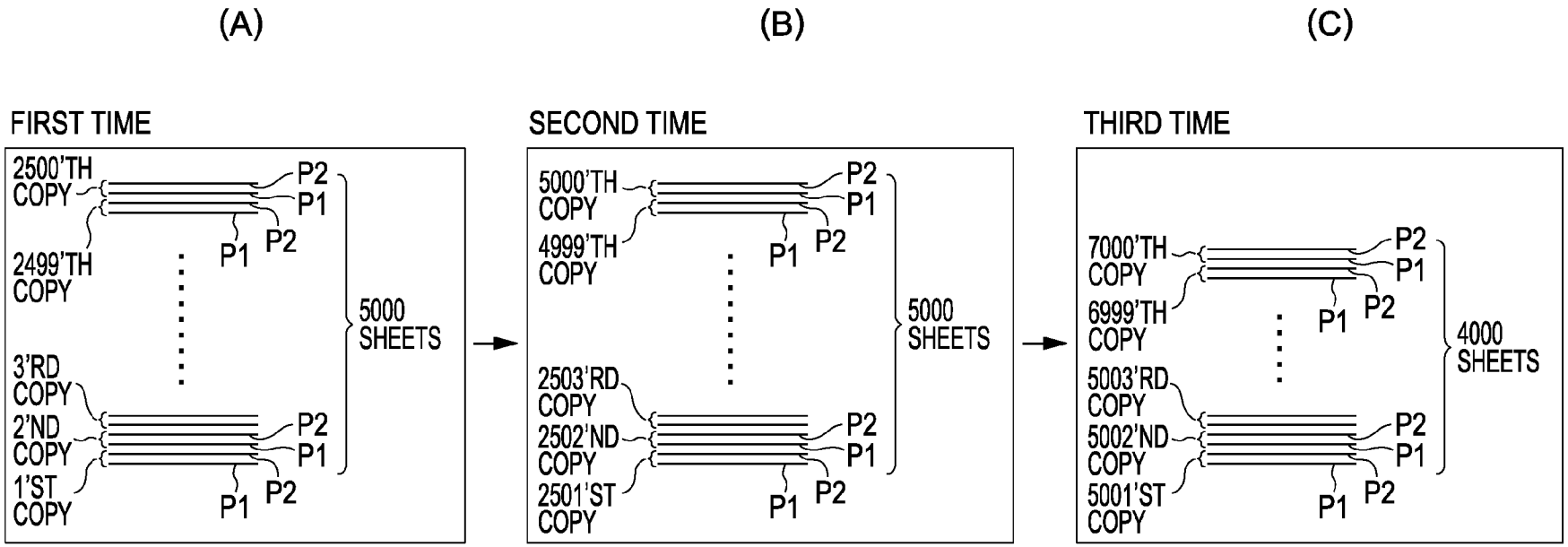
FIG. 21 is a diagram illustrating a stacking example with the non-group sorting method.

(A), (B), and (C) in FIG. 21 illustrate a stacking example by the non-group sorting method.

In a case where sheets are stacked in a certain stacker by the non-group sorting method, such as the P1 (first page), P2 (second page), P1, P2, and so on through P1, and P2, 5000 sheets (the P1 and P2 are each 2500 sheets) are stacked continuously (a first time has been completed: (A) in FIG. 21).

Stacking to the stacker is temporarily stopped at this time, so upon the user removing the sheets, again, such as the P1, P2, P1, P2, and so on through P1, and P2, 5000 sheets (the P1 and P2 are each 2500 sheets) are stacked continuously (a second time has been completed: (B) in FIG. 21).

Stacking to the stacker is temporarily stopped at this time, so upon the user removing the sheets, again, such as the P1, P2, P1, P2, and so on through P1, and P2, the remaining 4000 sheets (the P1 is 2000 sheets, and the P2 is 2000 sheets) are stacked continuously (a third time has been completed: (C) in FIG. 21).

Thus, the 14000 sheets have been stacked in the one stacker by being divided into three times. Here, more of the sheets on which the same image is printed than 4000 sheets have not been stacked at each time, which causes no problem with stackability (in a conventional case and in the present embodiment case).

Figure 22:
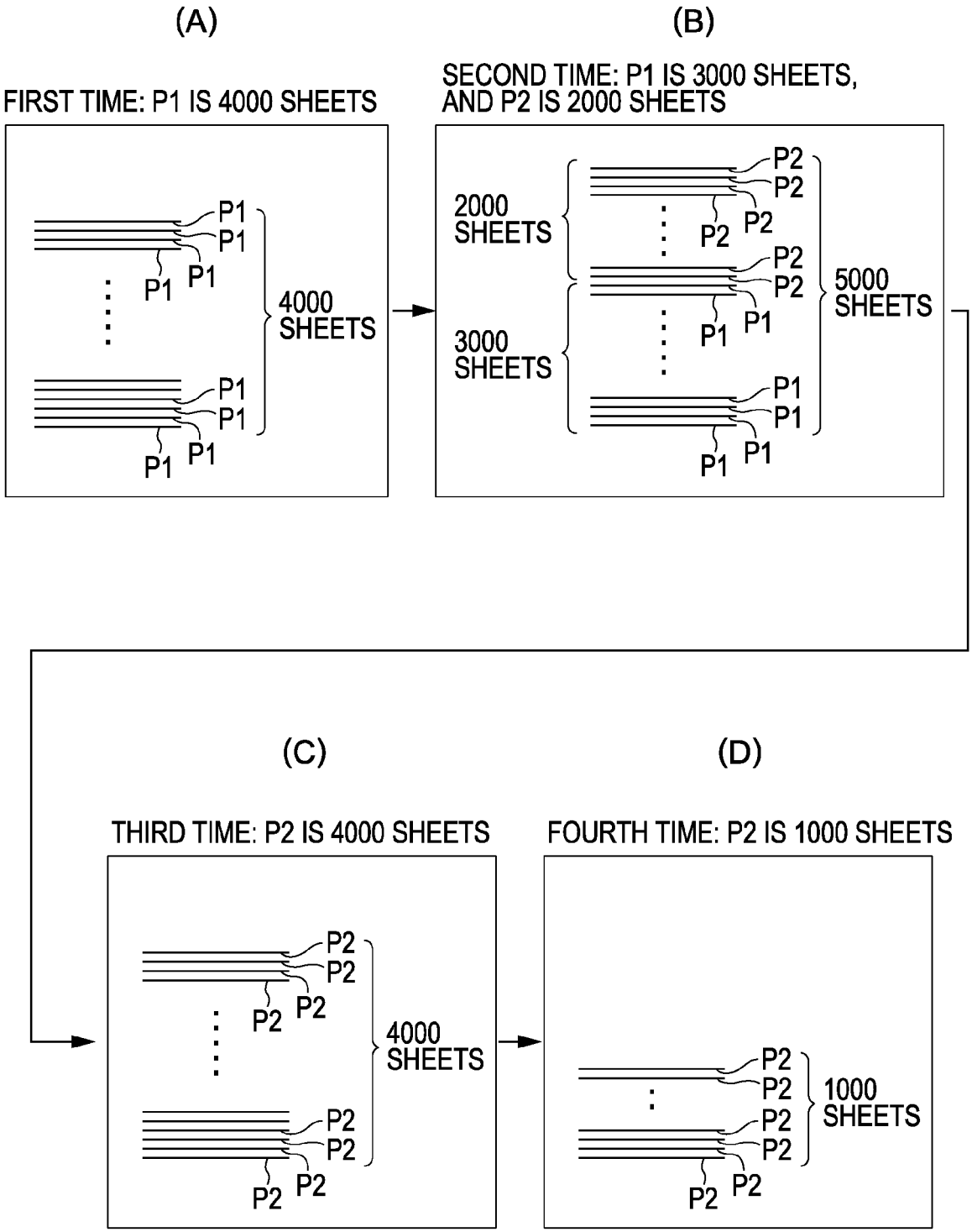
FIG. 22 is a stacking example with the group sorting method (in the case of applying the present invention).

(A), (B), (C), and (D) in FIG. 22 illustrate a stacking example by the group sorting method, which is also an example to which the present embodiment has been applied.

In a case where sheets are stacked in a certain stacker by the group sorting method, first, the first pages (P1) are stacked continuously. Subsequently, at the time 4000 sheets of the P1 being stacked, the determination result in step S1808 in FIG. 18 is YES, so stacking to the stacker is temporarily stopped in step S1811. That is to say, the 4000 sheets have been stacked in this stacker (a first time has been completed: (A) in FIG. 22).

Subsequently, upon the user removing the sheets, the remaining 3000 of the 7000 copies of the P1 are continuously stacked in the stacker, and subsequently, the second pages (P2) are stacked in the stacker continuously by 2000 sheets (a second time has been completed: (B) in FIG. 22). Here, a total of 5000 sheets have been stacked, and stacking to this stacker is temporarily stopped.

Subsequently, upon the user removing the sheets, stacking of the remaining P2 is started again. Subsequently, upon 4000 sheets being stacked in the stacker, the determination result in step S1808 in FIG. 18 is YES, and stacking to the stacker is temporarily stopped in step S1811. That is to say, the 4000 sheets have been stacked in this stacker (a third time has been completed: (C) in FIG. 22).

Subsequently, upon the user removing the sheets, the remaining 1000 sheets of the 7000 copies of the P2 are stacked in this stacker continuously (a fourth time has been completed: (D) in FIG. 22).

Thus, the 14000 sheets have been stacked in the one stacker by being divided into four times. Here, more of the sheets on which the same image is printed than 4000 sheets have not been stacked at each time. That is to say, with the second embodiment, the probability is low that an unstable or problematic stacked state such as inclining, shifting, shifting and falling, or the like will be caused, and in many cases, stacking is performed without any problem.

Third Embodiment

With the second embodiment, the actual printing operation and large-quantity stacking operation are started without confirming whether settings have been made for continuously stacking a great number of sheets relating to the same image exceeding the upper limit number of the same sheets X, before starting actual printing operations. At the point that the number of stacked sheets reaches the upper limit number of the same sheets X while continuously stacking the sheets relating to the same image, the printing operation and large-quantity stacking operation are temporarily stopped, and the user is prompted to remove the sheets on the large-capacity stacker.

On the other hand, with the third embodiment, the printing operation and large-quantity stacking operation are not temporarily stopped, the user is prompted to remove the sheets on the large-capacity stacker of which the stacked number has reached the upper limit number of the same sheets X, and the stacking destination of the following sheets is switched to another available large-capacity stacker. Also, in the event that another large-capacity stacker is not available, printing operation and large-quantity stacking operation are temporarily stopped. The user is prompted to remove the sheets on the large-capacity stacker, and upon confirmation being made that sheets have been removed from one of the large-capacity stackers, the printing operation and large-quantity stacking operation are resumed, with the stacking destination of the following sheets being switched to the large-capacity stacker from which the sheets have been removed.

With the third embodiment as well, as with the first and second embodiments, it is needless to say that the problem wherein the great number of sheets, on which an image is printed with the disposed amount of color material being great on the same region is printed, are continuously stacked in the same ejecting destination, and the sheets incline, shift, or shift and fall, the sides curve, or the like, can be prevented to a great degree.

Figure 18:
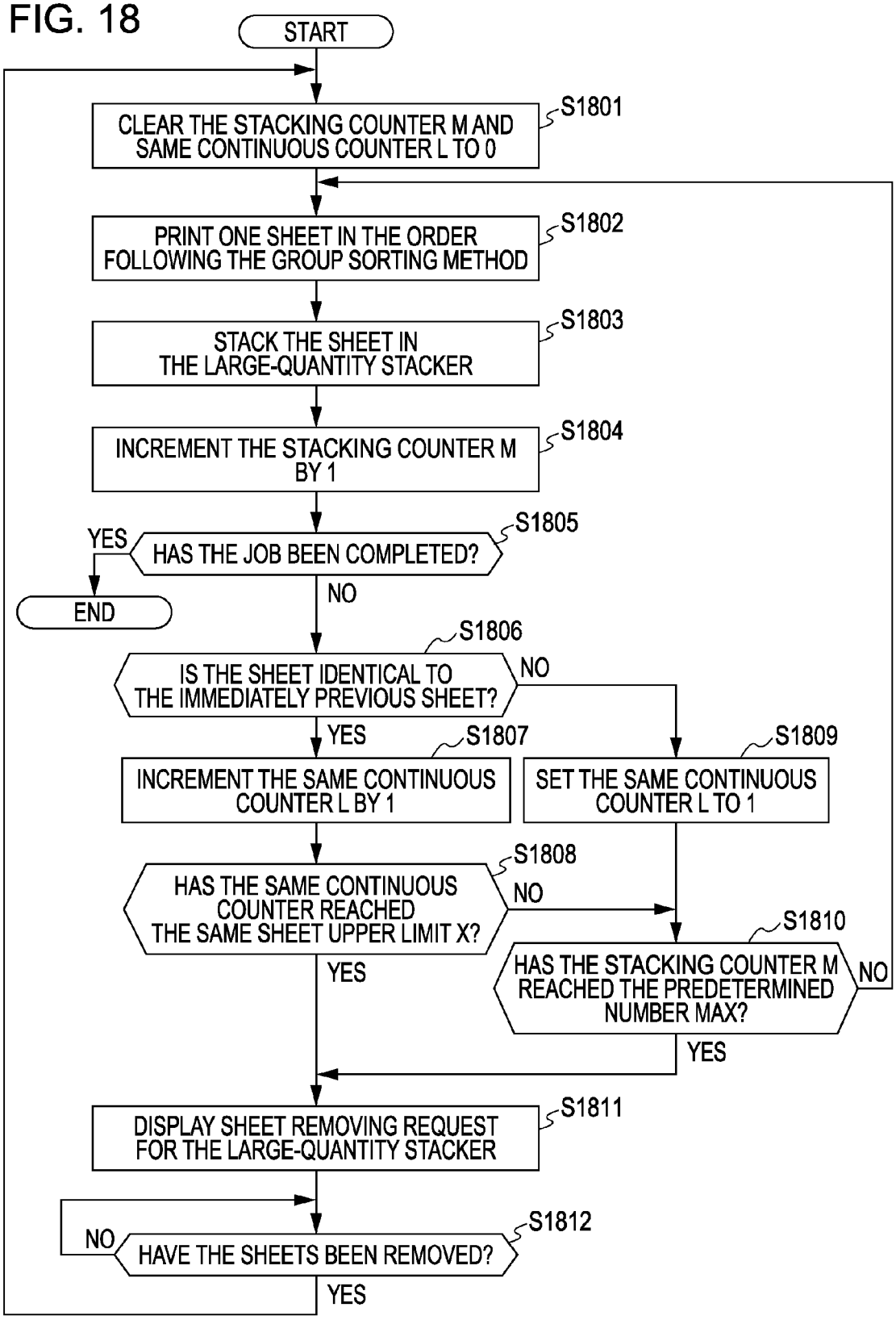
FIG. 18 is a flowchart illustrating the details of the large-quantity stacking processing with the group sorting method in step S1706 in FIG. 17.
Figure 23:
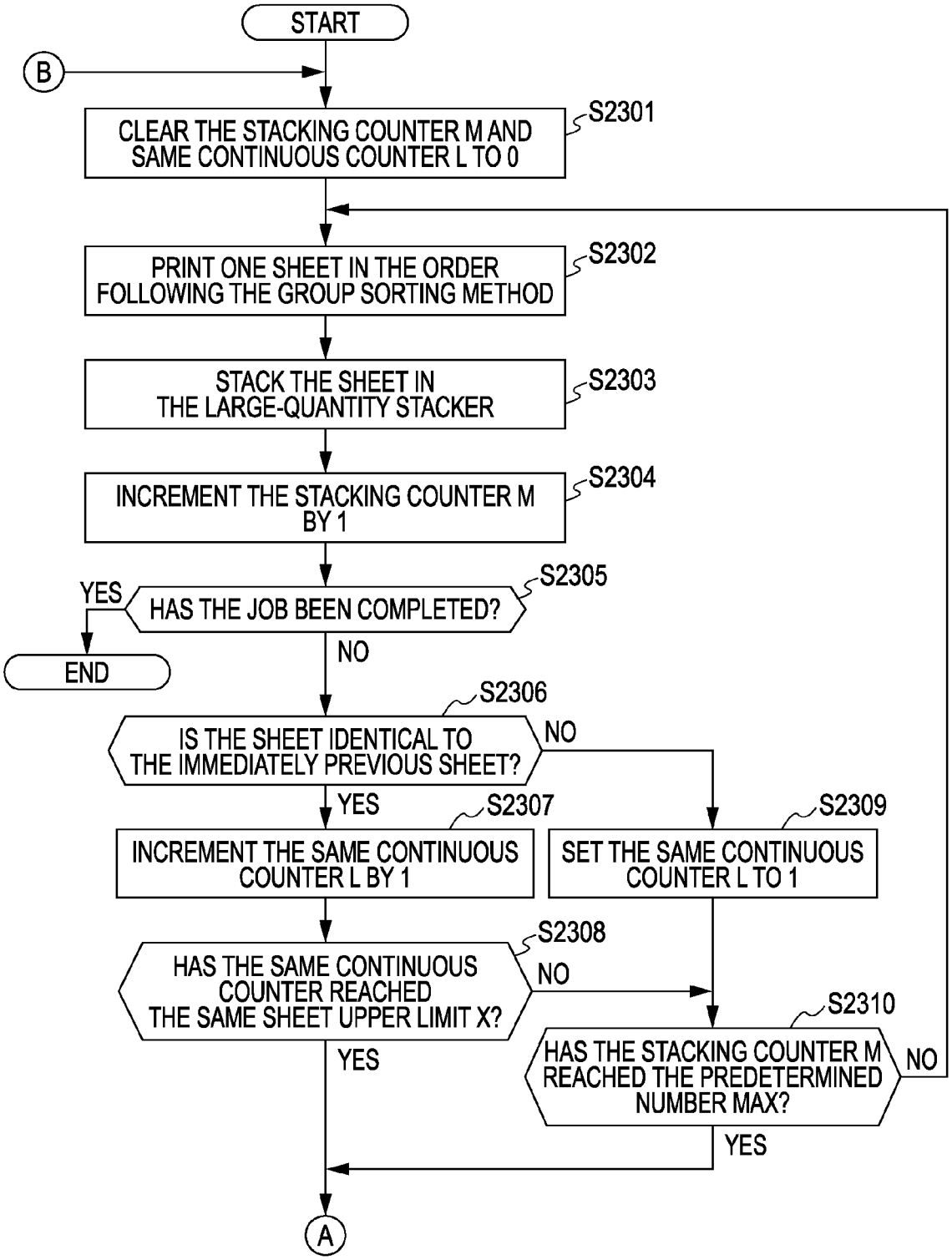
FIG. 23 is a flowchart illustrating the details of stacking operation with a group sorting method according to a third embodiment of the present invention.
Figure 24:
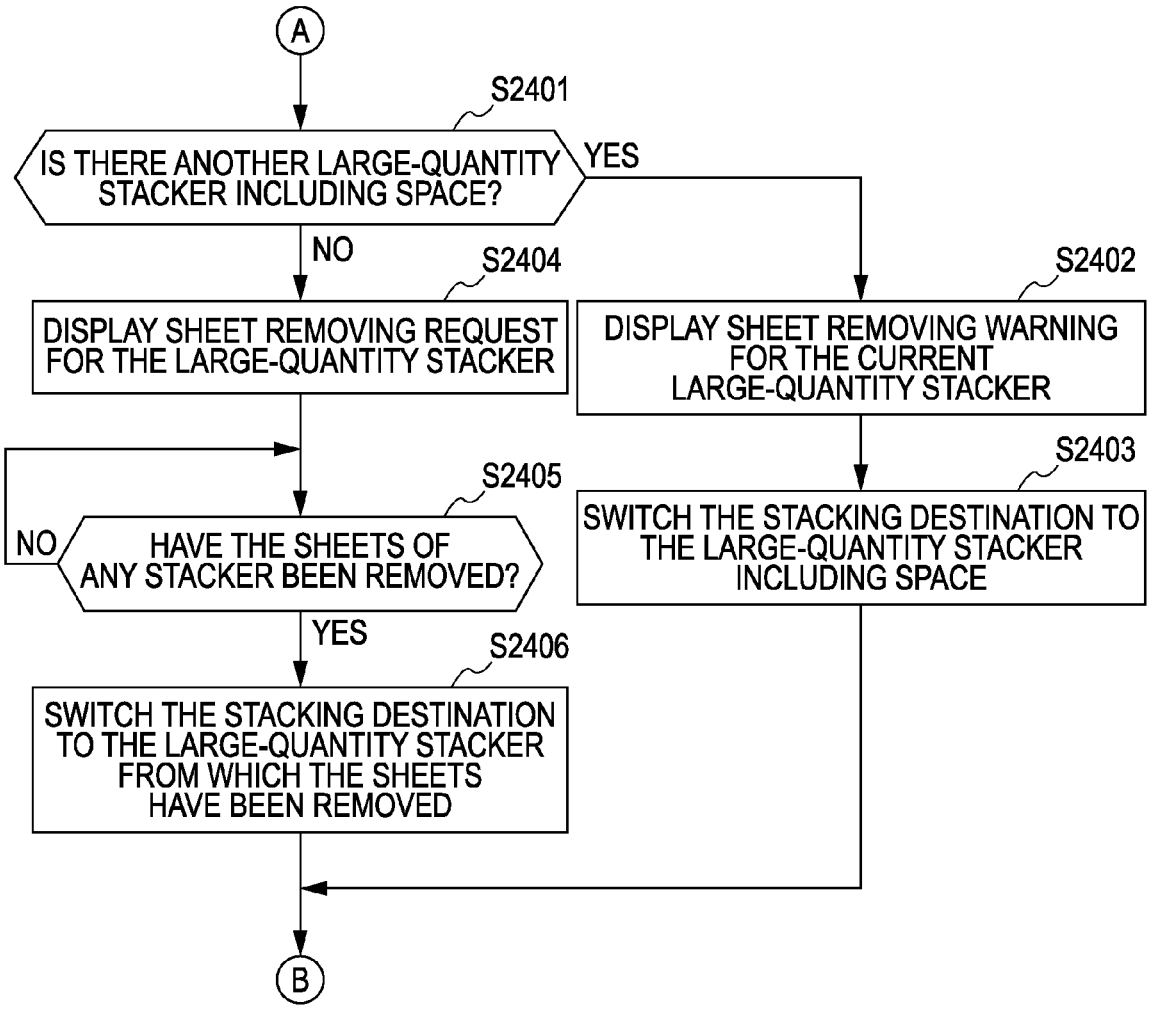
FIG. 24 is a flowchart which is a continuation of FIG. 23.

With the third embodiment, FIG. 18 with the second embodiment (details of the processing in step S1706 in FIG. 17) correspond to FIGS. 23 and 24. Accordingly, just the details of the processing in step S1706 in FIG. 17 will be described with reference to FIGS. 23 and 24.

The control unit 205 clears the stacking counter M and same continuous counter L to zero (step S2301).

Next, the control unit 205 causes the printing apparatus 100 to execute printing processing as to the next one sheet in the sequence following the group sorting method (step S2302). Next, the control unit 205 passes the sheet subjected to the printing processing through the point A, or points A and B in FIG. 3, and conveys this to the inner portion of the large-capacity stacker 200*a* or 200*b* specified as the sheet processing condition.

Subsequently, the control unit 205 executes the stacking processing of this job, i.e., the large-quantity stacking processing employing the group sorting method by the large-capacity stacker 200*a* or 200*b* (step S2303). Subsequently, the control unit 205 holds the sheet subjected to the large-quantity stacking processing by the large-capacity stacker 200*a* or 200*b* at an ejecting destination X1 or Y1 within the large-capacity stacker 200*a* or 200*b* without conveying this to another device (e.g., a downstream sheet processing device).

Next, the control unit 205 increments the stacking counter M by "1" (step S2304). Subsequently, the control unit 205 determines whether or not all of the processing relating to the job has been completed (step S2305). In a case where all of the processing has not been completed, the control unit 205 determines whether or not the sheet stacked in the large-capacity stacker 200*a* or 200*b* in step S2303 is a sheet on which the same image as the sheet stacked most recently is printed (step S2306).

As a result thereof, if not a sheet on which the same image as the sheet most recently stacked is printed, the control unit 205 sets the same continuous counter L to "1" (step S2309), and determines whether or not the stacking counter M has reached the maximum value (step S2310).

On the other hand, if the sheet is a sheet on which the same image as the sheet stacked most recently has been printed, the control unit 205 adds "1" to the same continuous counter L (step S2307). The control unit 205 then determines whether or not the same continuous counter L has reached the upper limit number of the same sheets X (step S2308). As a result thereof, if the same continuous counter L has reached the upper limit number of the same sheets X, the control unit 205 proceeds to step S2401.

On the other hand, in the event that the same continuous counter L has not reached the upper limit number of the same sheets X, the control unit 205 determines whether or not the stacking counter M has reached the maximum value (step S2310). If the stacking counter M has not reached the maximum value, the control unit 205 returns to step S2302, and if the stacking counter M has reached the maximum value, the control unit 205 proceeds to step S2401.

In step S2401, the control unit 205 determines whether or not there is a large-capacity stacker 200*b* or 200*a* available other than the large-capacity stacker 200*b* or 200*a* on which sheets are currently being stacked (large-capacity stacker in use). In step S2401, in the event that three or more large-capacity stackers are connected to the printing apparatus 100, determination is made regarding whether there is an available large-capacity stacker other than the large-capacity stacker currently in use.

As a result of the determination made in step S2401, if there is a large-capacity stacker 200*b* or 200*a* available other than the large-capacity stacker on which sheets are currently being stacked, the control unit 205 displays a warning to remove the sheets from the large-capacity stacker currently being used, on the touch panel unit 601 (step S2402). The control unit 205 then switches the stacking destination to an available large-capacity stacker (step S2403), and returns to step S2301 in FIG. 23. With the sequence of the steps S2401 through S2403, the printing operation and sheet stacking operation are not stopped.

On the other hand, in the event that a large-capacity stacker 200*b* or 200*a* other than the large-capacity stacker currently being used is not available, the control unit 205 temporarily stops the printing operation, and displays a message requesting the user to remove the sheets on the large-capacity stacker (step S2404). The control unit 205 then confirms removal of the sheets on one of the large-capacity stackers (step S2405). The removal of the sheets can be detected by the stacking sensor (not shown) provided in the large-capacity stacker 200*a* or 200*b*.

Next, the control unit 205 switches the stacking destination of the following sheets to the vacated large-capacity stacker (step S2406), returns to step S2301 in FIG. 23, and resumes the printing operation.

Specific Example for Describing Control Applied to the Above Embodiments

Next, description relating to control applied to the above-described embodiments will be supplemented by way of specific examples with reference to FIGS. 26A through 30B (specific example regarding control performed by the control unit 205, such as display control and the like). In the event that the job to be processed is group sorting which is a case of satisfying permitted conditions in an operating mode which gives weight to stackability of sheets, that is to say, in a case wherein the number of printing copies that has been set is a predetermined number or lower (the upper limit number of the same sheets X), group sorting is permitted as follows.

Note however, that the following control may be performed by a control unit such as a CPU or the like provided to the operating unit 204, instead of the control unit 205.

Figure 26A:
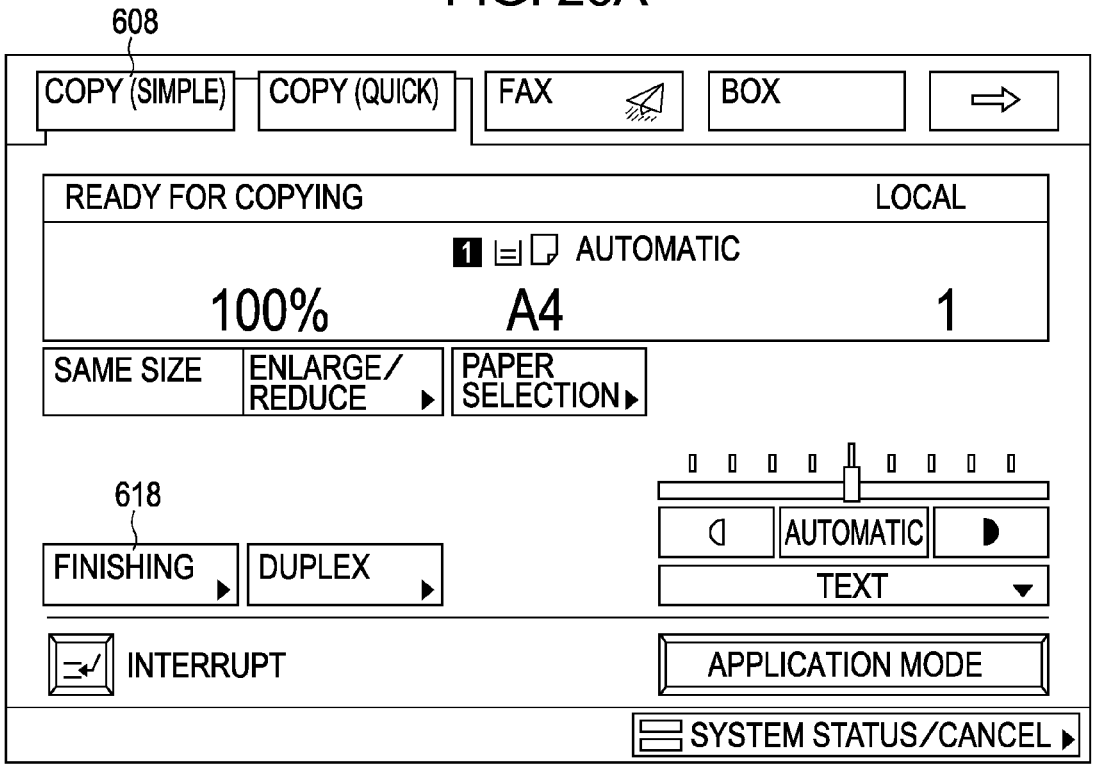
FIGS. 26A through 26C are diagrams illustrating screen transition wherein in accordance with the number of copies set prior to selection of a group sorting function being at or below a predetermined number of copies which satisfy a condition for permitting the group sorting, selection of the group sorting function is enabled.
Figure 26B:
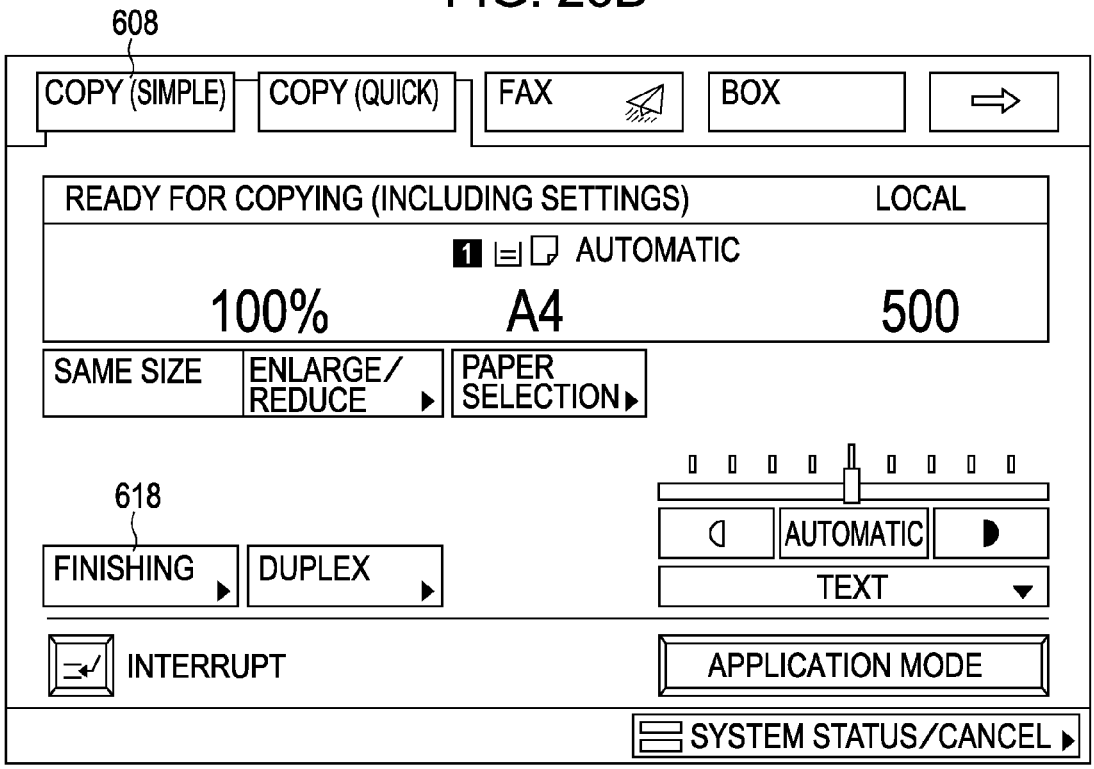
Figure 26C:
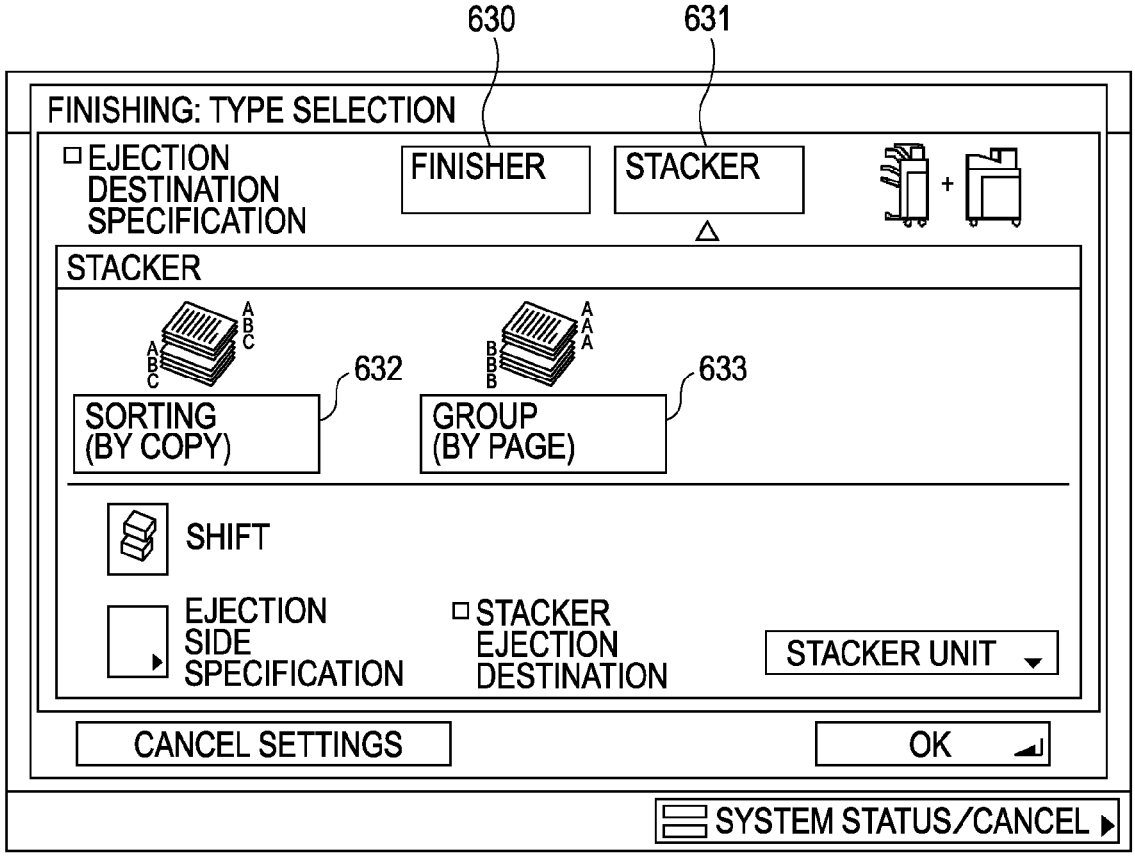

FIGS. 26A through 26C indicate that the number of printing copies set before selection of the group sorting function enables selection of this group sorting function in accordance with being a predetermined number of sheets or lower satisfying the permitted conditions for the group sorting.

FIG. 26A shows a state wherein, as a result of the "copy (simple)" tab 608 having been operated, a basic GUI screen relating to the "copy (simple)" function has been displayed. In this FIG. 26A, a display is made to the effect that the enlargement/reduction size is set to "100%", the sheet size to "A4", and the number of copies to "1", by default. Let us say that in this display state, the user inputs a number of printing copies "500" from the numeric keys 607 shown in FIG. 6, and that this number of printing copies "500" is a number of copies regarding which finishing processing (sheet processing) by "group (by page)" can be made. In this case, the control unit 205 displays the changed number of printing copies "500" as shown in FIG. 26B.

Further, the control unit 205 displays the a GUI screen relating to the "finishing" shown in FIG. 26C, and displays the "group (by page)" key 633 in an operable state in accordance with operation of the "stacker" key 631 in this GUI screen.

Note that with the GUI screen relating to "finishing" shown in FIG. 26C, the "sorting (by copy)" key 632 is also displayed in a selectable state. Also, with the GUI screen relating to "finishing" shown in FIG. 26C, the "sorting (by copy)" key 632 and the "group (by page)" key 633 are also displayed in a selectable state, in the case of having operated the "finisher" key 630 as well.

Figure 27A:
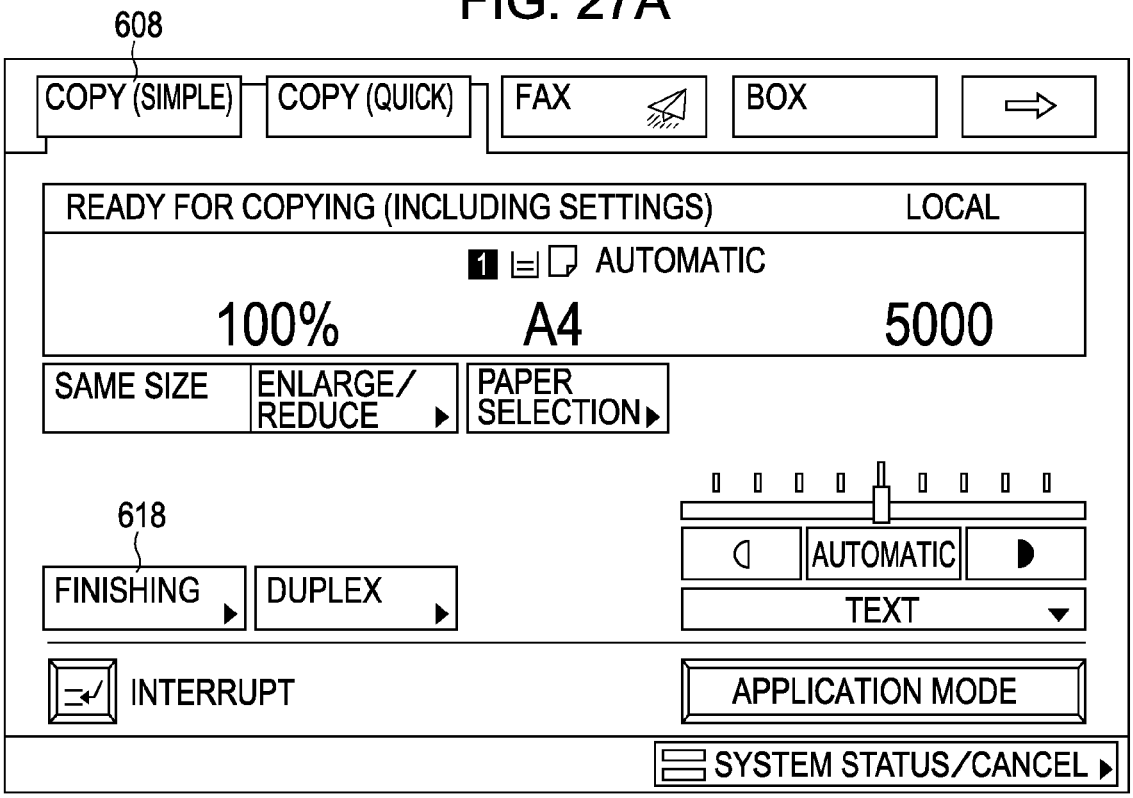
FIGS. 27A and 27B are diagrams illustrating screen transition wherein in accordance with the number of copies set prior to selection of a group sorting function being at or above a predetermined number of copies which do not satisfy a condition for permitting the group sorting, selection of the group sorting function is disabled.
Figure 27B:
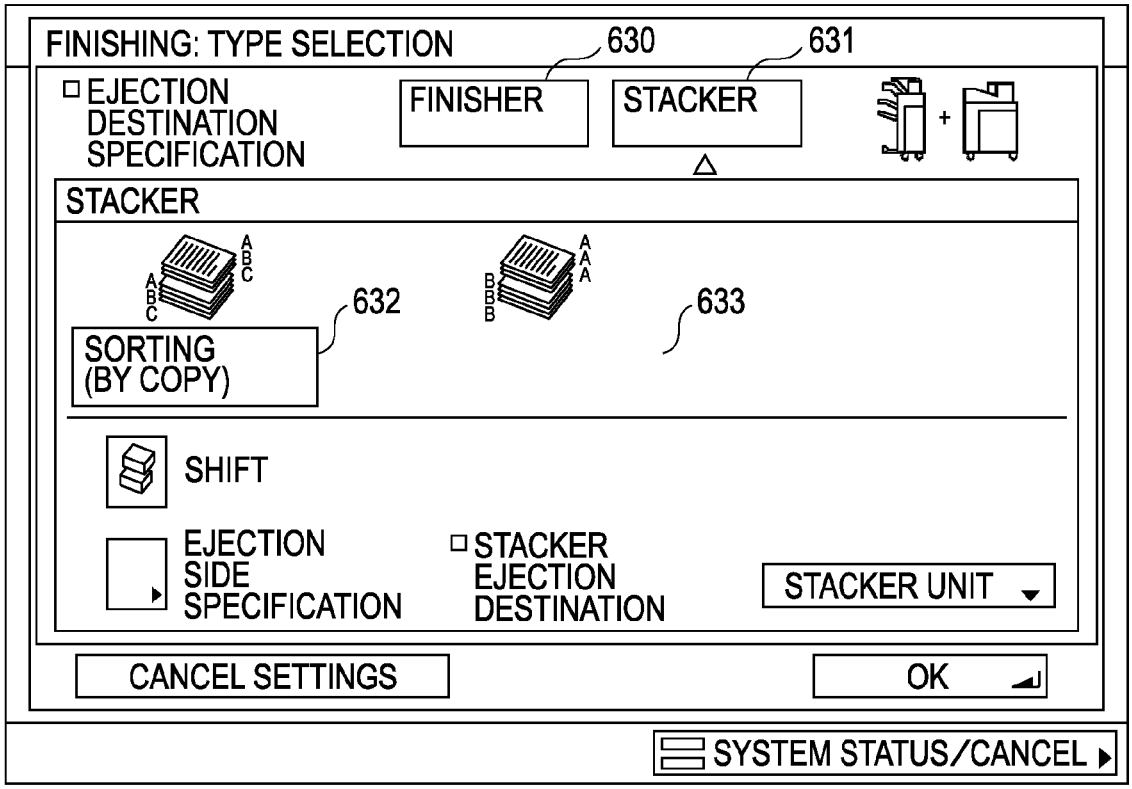

FIGS. 27A and 27B indicate that the number of printing copies set before selection of the group sorting function disables selection of this group sorting function in accordance with being a predetermined number of sheets or more not satisfying the permitted conditions for the group sorting.

With the GUI screen in FIG. 27A, "5000" is set for the number of printing copies. Let us say that the number of printing copies "5000" is a number of copies which does not satisfy the permitted conditions for the group sorting. In this case as well, the control unit 205 displays the GUI screen relating to "finishing" shown in FIG. 27B in accordance with operations of the "finishing" key 618 at the GUI screen in FIG. 27A.

However, the number of printing copies "5000" which does not satisfy the permitted conditions for the group sorting has already been set. Accordingly, the control unit 205 effects control such that, as shown in FIG. 27B, even in the event that the "stacker" key 631 is operated in the GUI screen relating to "finishing", the "group (by page)" key 633 is displayed in a grayed out state so as to be inoperable. In this case, the "sorting (by copy)" key 632 is displayed in an operable state, since there is almost no chance of trouble such as sheet bundles falling over due to stacking great quantities in sorting processing by copy.

Now, in the event that the "finisher" key 630 has been operated in the GUI screen relating to "finishing" shown in FIG. 27B, the "sorting (by copy)" key 632 is displayed in an operable state. On the other hand, the "group (by page)" key 633 may be displayed in an inoperable state if the amount of sheet bundles stacked is as great as the stacker at the time of finisher processing.

Due to the above display control, in the first through third embodiments, and particularly in the first embodiment, the control unit 205 does not have to perform useless processing (steps S1204 through S1208 in FIG. 12, etc.), and the processing load on the control unit 205 can be alleviated. Also, useless input operations can be avoided for the user, thereby improving usability.

Figure 28A:
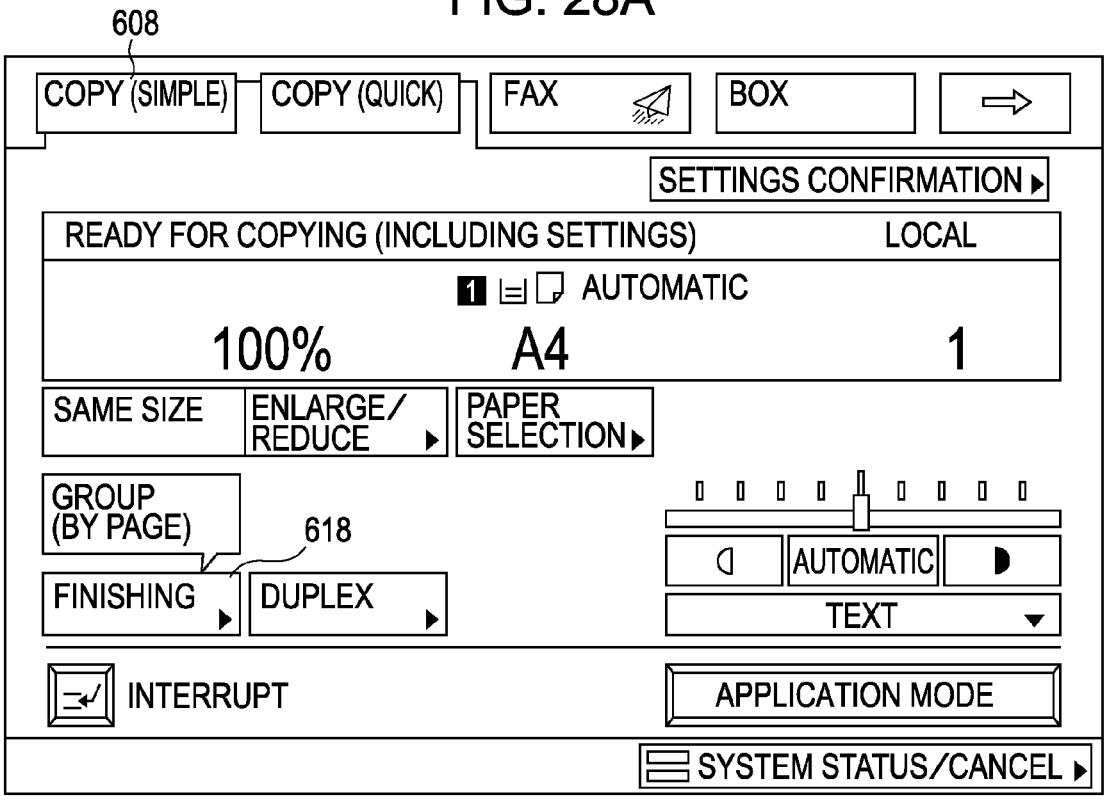
FIGS. 28A and 28B are diagrams illustrating screen transition wherein, in a case where a group sorting function is selected before setting the number of copies, the number of copies which will be accepted thereafter is restricted.
Figure 28B:
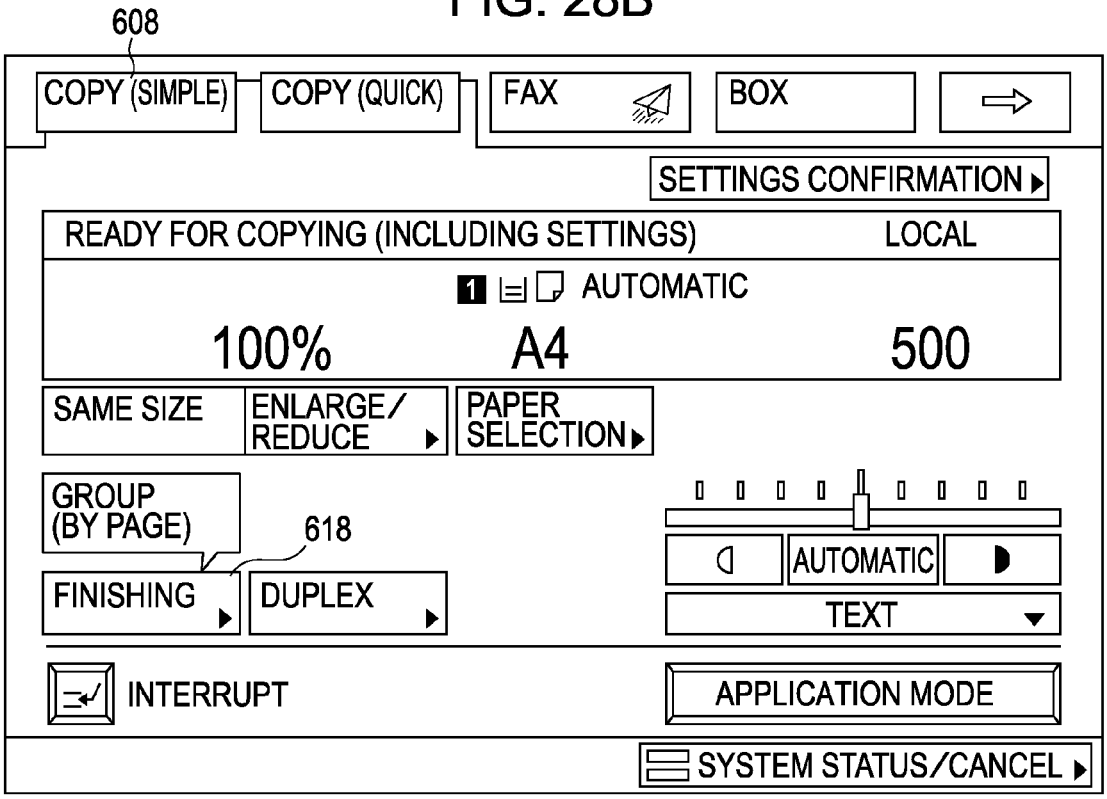

FIGS. 28A and 28B indicate that in the event that the group sort function is selected before setting the number of printing copies, the number of printing copies to be set thereafter is restricted. FIG. 28A shows a state wherein, as a result of the "copy (simple)" tab 608 having been operated, a basic GUI screen relating to the "copy (simple)" function has been displayed. In this FIG. 28A, a display is made to the effect that the enlargement/reduction size is set to "100%", the sheet size to "A4", and the number of copies to "1", by default.

Let us say that in the basic GUI screen in FIG. 28A, the user has operated the "finishing" key 618, and operated the "group (by page)" key 633 in the GUI screen relating to "finishing" (see FIGS. 26A and 27B) whereupon the display has returned to the basic GUI screen in FIG. 28A. Also, let us say that the user has attempted to input the number of printing copies "5000" which does not satisfy the permitted conditions for the group sorting at this returning basic GUI screen.

In this case, as shown in FIG. 28B, the control unit 205 permits input of up to "500", as shown in FIG. 28B. However, even if the user attempts to input another "0" to make "5000", the number of printing copies "5000" is a number of printing copies which does not satisfy the permitted conditions for the group sorting, so the control unit 205 inhibits input of the next "0" following input of "5", "0", and "0".

As an application example of this, input of a number of printing copies which does not satisfy the permitted conditions for group sorting can be inhibited in a case where the number of copy originals is one sheet, even if group sort has not been set.

Accordingly, with the first through third embodiments, and particularly the first embodiment, the control unit 205 does not have to perform useless processing (steps S1204 through S1208 in FIG. 12, etc.), and the processing load on the control unit 205 can be alleviated. Also, useless input operations can be avoided for the user, and further, the user will most likely be strongly reminded of the number of printing copies satisfying the permitted conditions for group sorting.

Figure 29A:
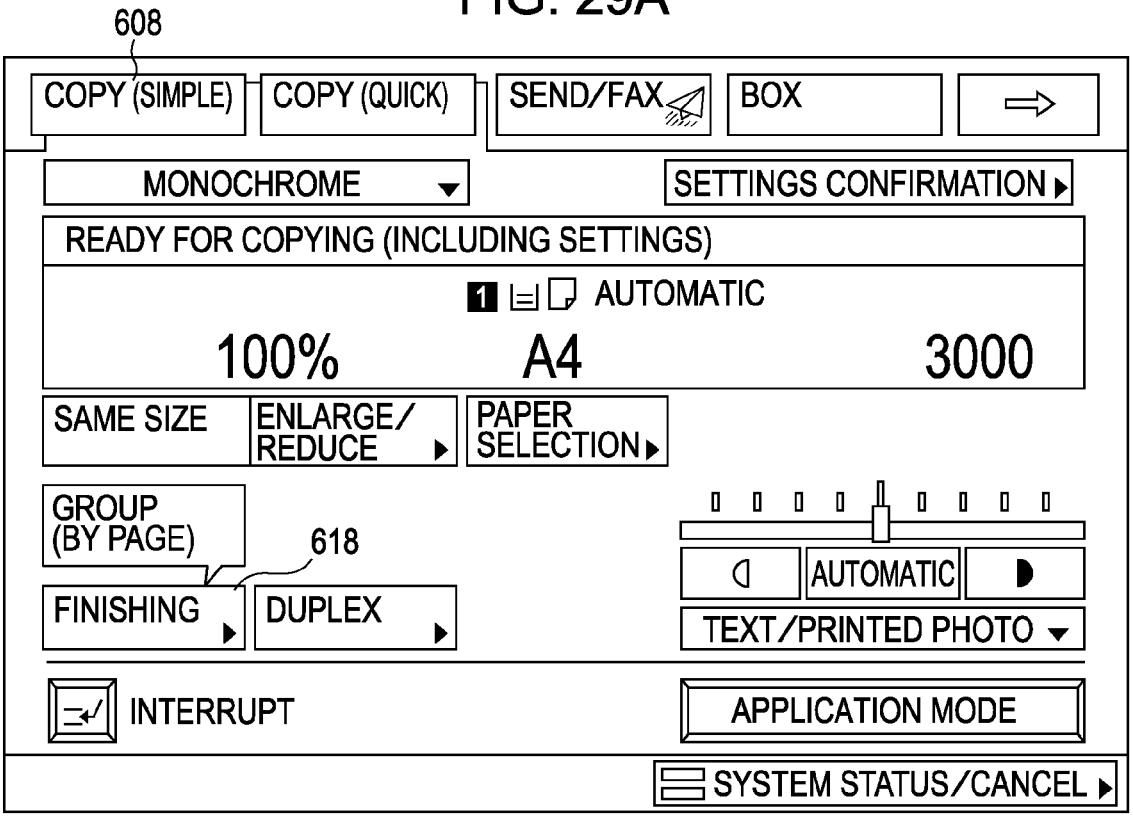
FIGS. 29A through 29C are diagrams illustrating a control example wherein with the group sorting function at the time of a color printing mode, the upper limit number of sheets of the number of copies (the upper limit number of the same sheets) is set smaller than a case of the group sorting function at the time of a monochrome printing mode.
Figure 29B:
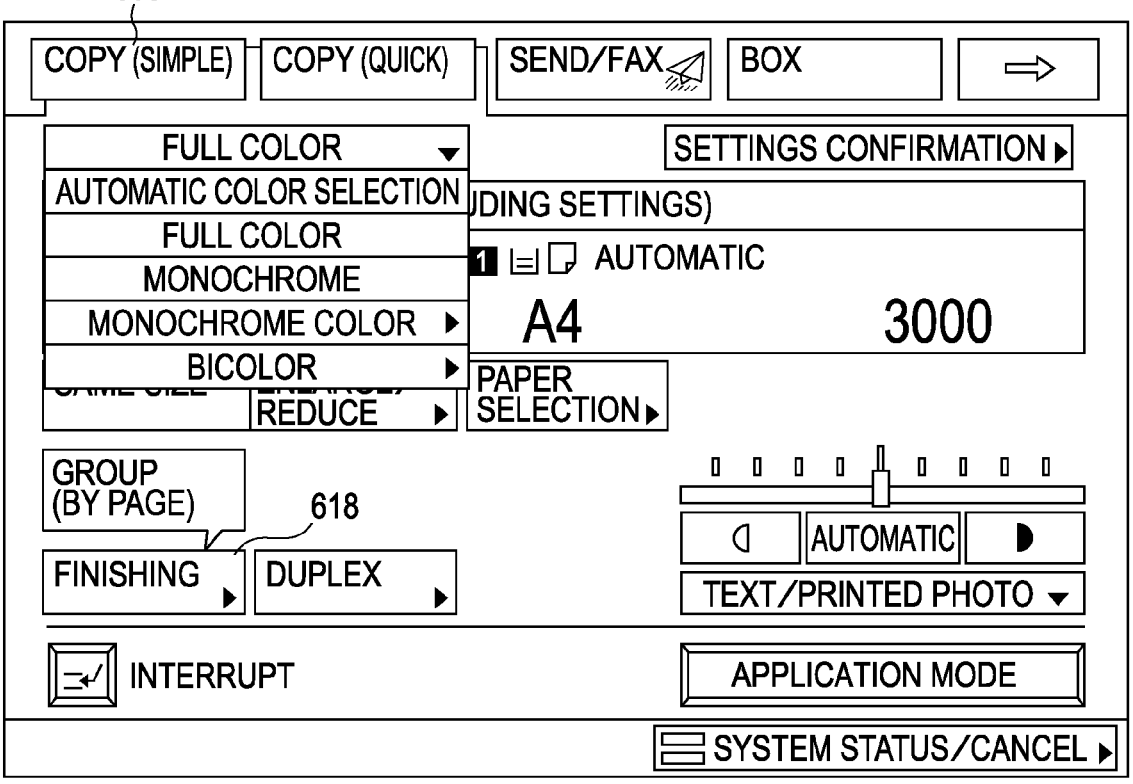
Figure 29C:
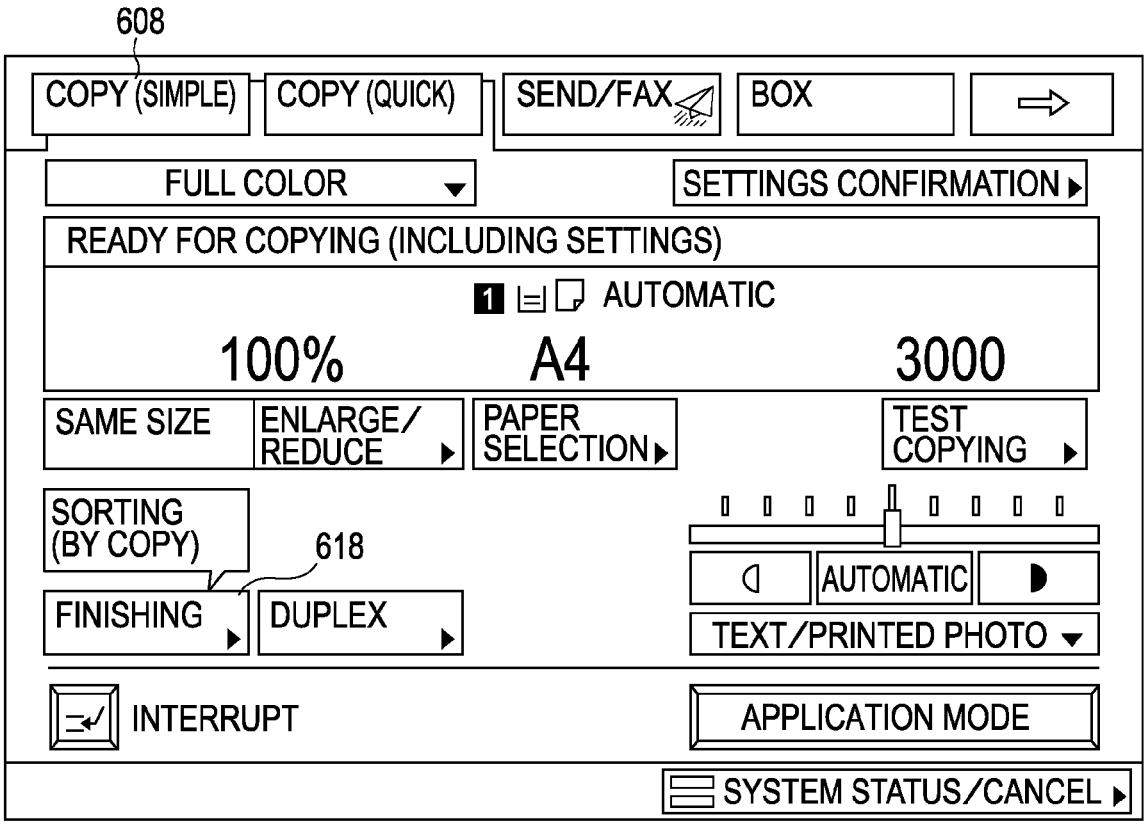

FIGS. 29A through 29C show that with the group sort function in the color printing mode, the upper limit number of printing copies (the upper limit number of the same sheets X) is smaller than the case of the group sort function in the monochrome printing mode. The reason is that with the case of color images, four colors of toner, Y, M, C, and K are applied, so even if the number of sheets laid down is the same, the probability that the difference in thickness due to toner will be greater than with the case of a monochrome image is high.

With the basic GUI screen relating to the "copy (simple)" function in FIG. 29A, a display is made to the effect that the enlargement/reduction size is set to "100%", and the sheet size is set to "A4" by default. Further, with the basic GUI screen in FIG. 29A, a monochrome printing mode is set, and an echo display of the input number of printing copies "3000" is shown.

Let us say that this number of printing copies "3000" is a number of printing copies which satisfies the permitted conditions for group sorting when in the monochrome printing mode, but is a number of printing copies which does not satisfy the permitted conditions for group sorting when in the color printing mode.

In this case, with the basic GUI screen in FIG. 29A where the monochrome printing mode is set and the number of printing copies "3000" is set, "group (by page)" can be set by operating the "finishing" key 618. That is to say, with this GUI screen relating to "finishing", the state shown in FIG. 26C is realized. Specifically, the "sorting (by copy)" key 632 and the "group (by page)" key 633 are both displayed in an operable state, regardless which of the "stacker" key 631 and "finisher" key 630 are operated.

In the basic GUI screen in FIG. 29A, changing from the monochrome printing mode to the color printing mode as shown in FIG. 29B causes the "group (by page)" to be automatically disengaged and changed to "sort (by copy)", as shown in FIG. 29C.

Thus, automatically changing printing conditions permitting printing regarding the set printing conditions enables large-quantity printing to be executed even in the event that the user is busy and leaves the installation location of the printing system immediately after ending the setting operations, for example. Note that advantages the same as with the case of FIGS. 29A through 29C can be obtained with the case of FIGS. 30A through 30C, as well.

Figure 30A:
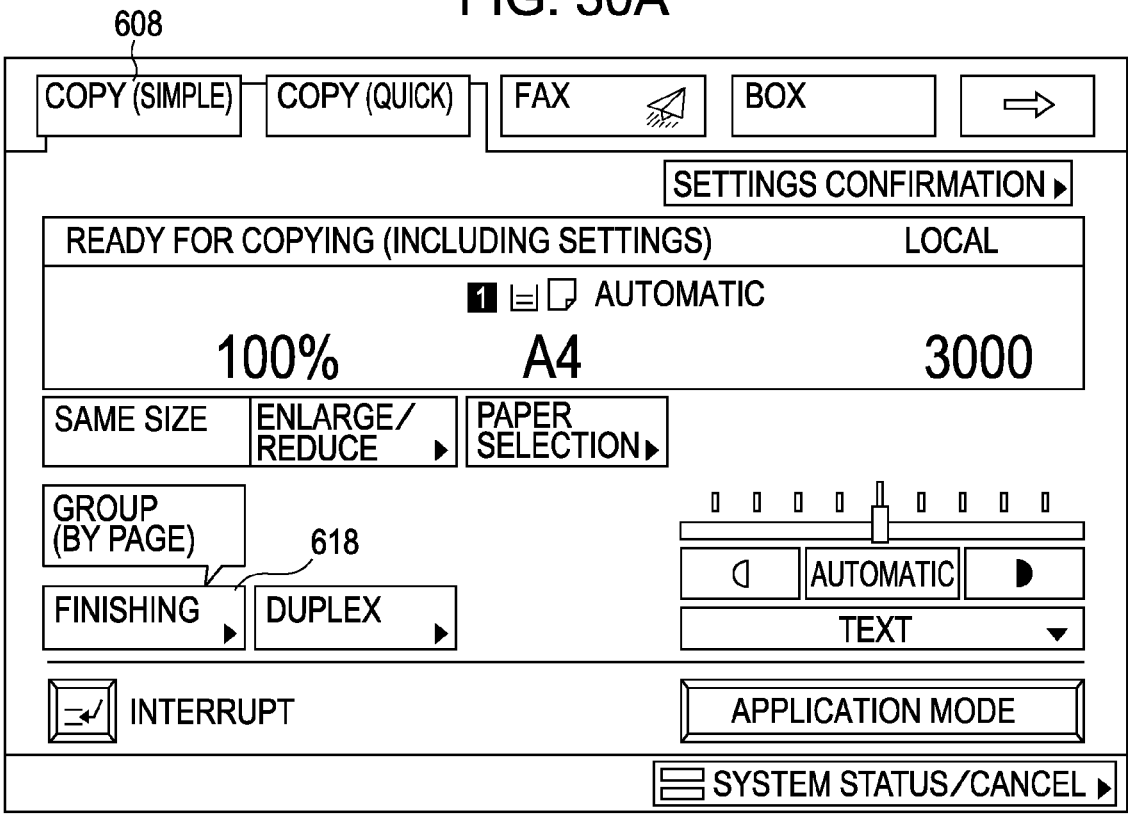
FIGS. 30A through 30C are diagrams illustrating a control example wherein with the group sorting function at the time of a photo printing mode, the upper limit number of sheets of the number of copies (the upper limit number of the same sheets) is set smaller than a case of the group sorting function at the time of a non-photo printing mode.
Figure 30B:
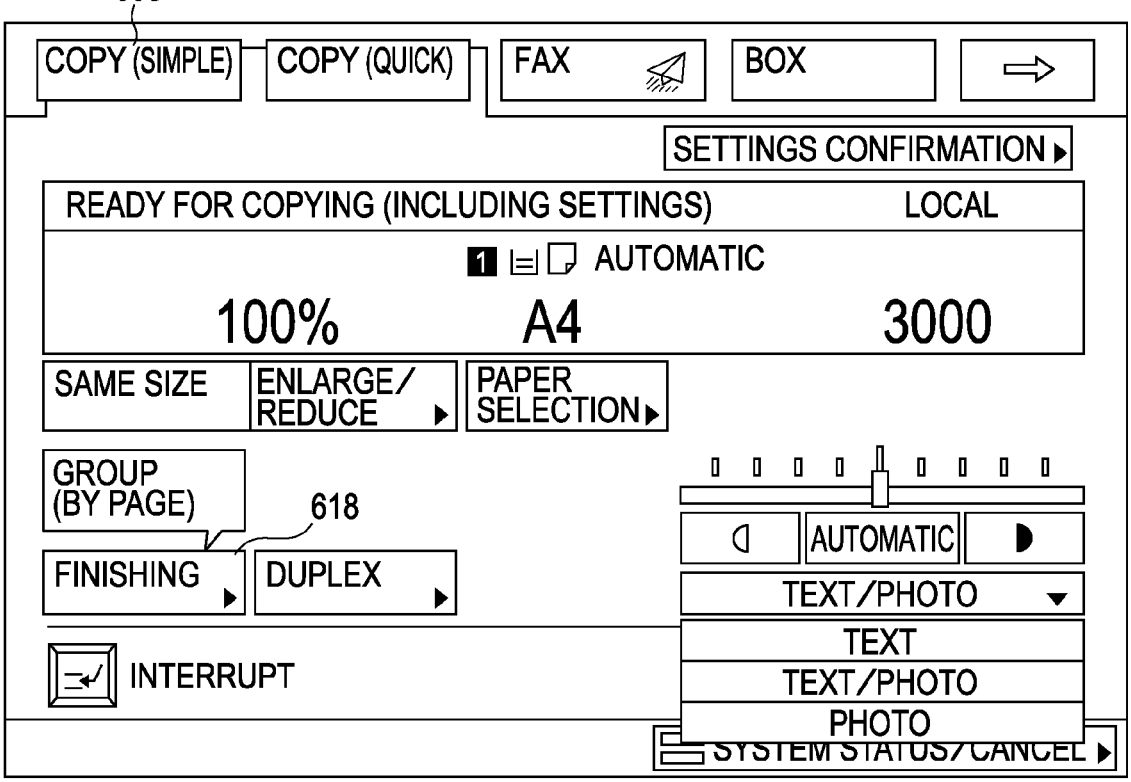
Figure 30C:
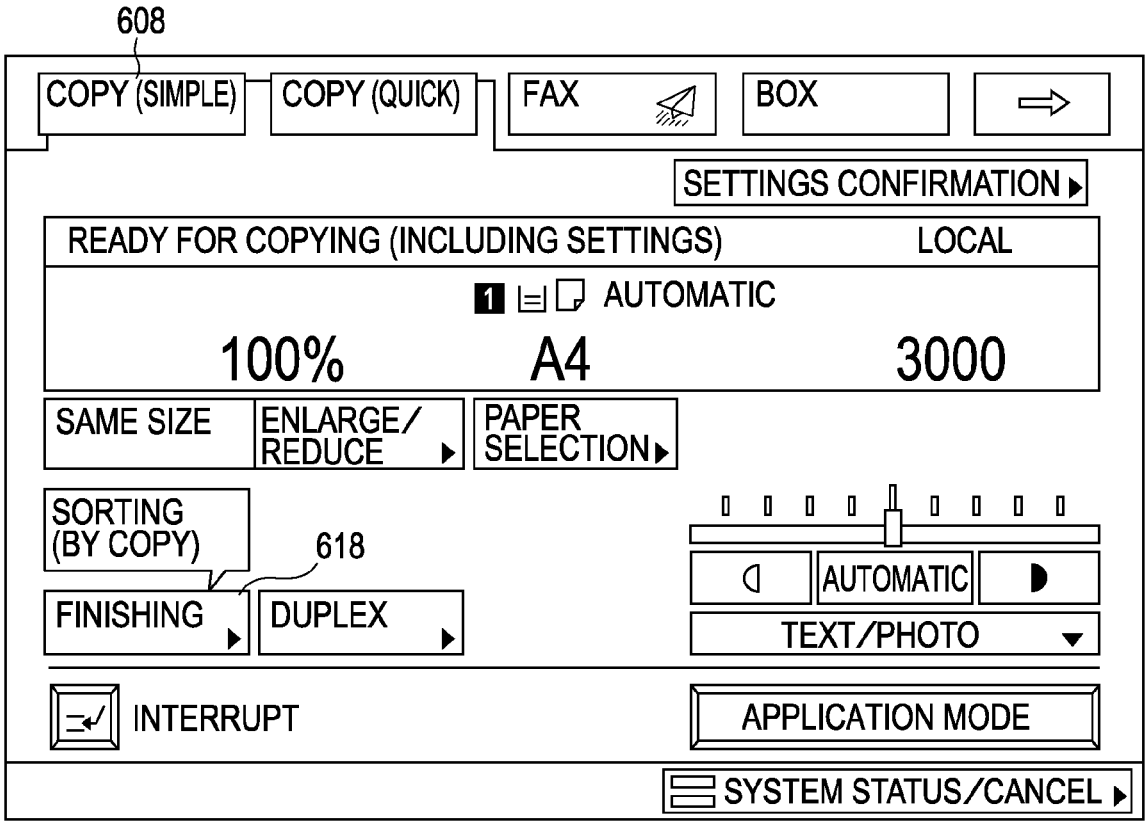

FIGS. 30A through 30C show that with the group sort function in the photo printing mode, the upper limit number of printing copies (the upper limit number of the same sheets X) is smaller than the case of the group sort function in the non-photo printing mode. The reason is that with the case of photo images, the amount of toner applied tends to be greater, so even if the number of sheets laid down is the same, the probability that the difference in thickness due to toner will be greater than with the case of a non-photo image is high. Note that the photo printing mode includes the text/photo printing mode, and the non-photo printing mode is equivalent to the text printing mode.

With the basic GUI screen relating to the "copy (simple)" function in FIG. 30A, a display is made to the effect that the enlargement/reduction size is set to "100%", and the sheet size is set to "A4" by default, in the event that the "copy (simple)" function has been set (selected). Further, with the basic GUI screen in FIG. 30A, a text printing mode is set, and an echo display of the input number of printing copies "3000" is shown.

Let us say that this number of printing copies "3000" is a number of printing copies which satisfies the permitted conditions for group sorting when in the non-photo printing mode, but is a number of printing copies which does not satisfy the permitted conditions for group sorting when in the photo (text/photo) printing mode.

In this case, with the basic GUI screen in FIG. 30A where the text printing mode is set and the number of printing copies "3000" is set, "group (by page)" can be set by operating the "finishing" key 618.

That is to say, with this GUI screen relating to "finishing", the state shown in FIG. 26C is realized. Specifically, the "sorting (by copy)" key 632 and the "group (by page)" key 633 are both displayed in an operable state, regardless which of the "stacker" key 631 and "finisher" key 630 are operated.

In the basic GUI screen in FIG. 30A, changing from the text printing mode to the text/photo printing mode as shown in FIG. 30B causes the "group (by page)" to be automatically disengaged and changed to "sort (by copy)", as shown in FIG. 30C.

Other Embodiments

The present invention is not restricted to the above first through third embodiments. For example, let us say that the group sort mode is set at the operating unit 204, and there is the possibility that trouble may occur such as sheets inclining, shifting, or shifting and falling, due to the stacking conditions of sheets relating to settings made under the group sort mode. In this case, the control unit 205 may automatically change settings to the non-group sort mode and execute the printing operation and sheet stacking operation. At the point that the printing operation and sheet stacking operation are completed, the control unit 205 may also display the confirmation message shown in FIG. 25 on the touch panel unit 601.

Also, the functions of the first through third embodiments may be applied in a case wherein sheets relating to the same image end up being continuously stacked even of the group sort mode is not set. For example, the functions and the like of the first through third embodiments can be applied in a case wherein the number of printing copies set is greater than the upper limit number of the same sheets X. The reason is that in this case as well, if the number of printing copies set is greater than the upper limit number of the same sheets X, sheets relating to the same image are continuously stacked, and the stacked sheets may become unstable.

Further, the functions of the first through third embodiments and the like can be applied in a case wherein, not necessarily the same image, but images having similar image features are printed in great amounts and continuously stacked on a stacker or the like.

Figure 31:
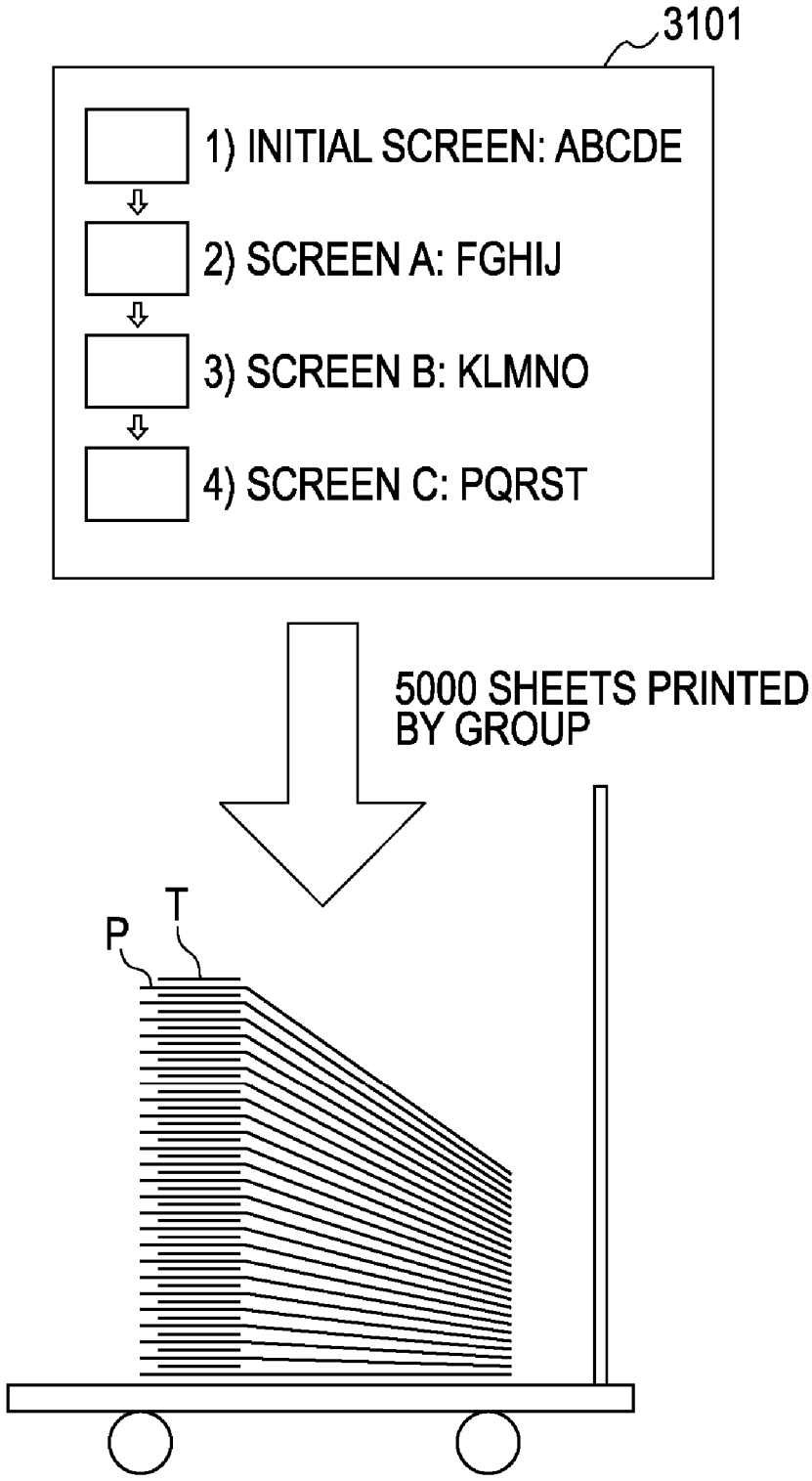
FIG. 31 is a diagram for describing a problem conventionally caused in a case of stacking a massive number of sheets.

Here, the term "images having similar image features" refers to images such as shown in FIG. 31 for example, with images using a great amount of toner (color material) being arrayed on the left ¼ region of the page and text string arrays using little toner (color material) being arrayed on the remainder of the page. The reason is that, with images having features such as shown in FIG. 31, regardless of whether the images being printed are not the same, continuously printing and stacking sheets having such different images may result in the sheets inclining or shifting and falling.

Such cases can be handled by analyzing (inspecting) the image to be printed, and predicting disparity in color material exceeding a predetermined value, or setting a particular mode with the operating unit 204, for example, as described later.

Note that the term "images having similar image features" includes "images of the same page", "color images", "photo images", and "duplex-printed images", as a matter of course.

Also, an arrangement may be made wherein the default upper limit number of the same sheets X in the first through third embodiments is changed in accordance with duplex printing mode or simplex printing mode. For example, in the case of duplex printing mode, the upper limit number of the same sheets X may be set to a lower value as compared to the case of the simplex printing mode. In the case of the duplex printing mode, the amount of toner applied to the same region on the front and rear of the sheet may overlap, such that difference in the thickness of toner is greater even if the number of stacked sheets is the same.

Further, in a case wherein images to be printed are analyzed and disparity in the amount of color material exceeding a predetermined amount is predicted, stacking at a single stacking destination in the group sort mode may be forbidden. This is due to a determination from analyzing the images to be printed that the printing conditions are such that the amount of color material may be great in the same region on multiple sheets.

Also, as for a configuration (inspecting unit) for being used in analyzing images to actually be printed, a unit (not shown) having a camera function and/or OCR function is provided in the vicinity of the ejecting roller 310. Image data acquired by this unit is transferred to the control unit 205. Thus, images actually printed on the sheets conveyed into the sheet processing device 200 from the printing apparatus 100 are checked (inspected). An arrangement may be made wherein such an actual-measurement type configuration is used to realize the above-described embodiments without using settings at the operating unit or counter information.

That is to say, as for a configuration for determining whether or not stack, on the same stacker, multiple sheets which have images printed on the same printing regions of each sheet, determination may be made be determining whether or not group sort settings have been made at the operating unit, or an arrangement may be made wherein a configuration for counting sheets being actually printed is further provided, or an arrangement may be made wherein the printed images are inspected by actual measurement with a sensor having a camera function as described above.

Also, an arrangement may be made wherein the operating unit 205 of the printing apparatus 100 does not execute both operating control relating to the operating unit 204 and output control relating to actual printing operations of the printing system 1000, but rather a separate control unit, such as an operating control unit, performs the operating control.

Further, an arrangement may be made wherein a control unit other than the control unit 205 performs part or all of the multiple types of control which the control unit 205 has been described as performing. Examples of control units other than the control unit 205 which can be used include an external controller disposed in a housing other than that of the printing apparatus 100, a CPU of a remote external device such as the PC 104, and a CPU of an inline finisher.

Accordingly, a very flexible system, capable of handling environments in which the printing system 1000 may be installed, can be constructed. In other words, a printing system with usability in view of trends in future digital printing systems can be provided. For example, a handy and flexible printing environment can be configured capable of handling usage cases and needs expected under conventional POD environments, and various arrangements can be provided for product realization.

Note that above-described configurations of the printing system 1000 can be used in combination in any way as long as the functionalities thereof are not compromised.

The first through third embodiments which are system configurations having various configurations described above enable realizing of maintaining stackability taking into consideration printing conditions, with a simple arrangement. However, the system configuration does not have to include all of these. For example, an arrangement capable of executing control of the primary portions relating to the confirmation printing function of the above-described first through third embodiments can be applied to cases of system configurations not including all.

Other Configurations

Functions illustrated in drawings relating to the above-described embodiments may be executed by a host computer (e.g., PC 103 or PC 104) by a program externally installed. In this case, a configuration is made enabling data for displaying screens in the same way as the screens described with the embodiments to be externally installed, and the user interface screens to be presented on the display unit of the host computer.

As a matter of course, the present invention may be carried out by a computer-readable recording medium recording (storing) program code of software (a computer-executable program) realizing the above-described functions being supplied to the system or apparatus, and a computer (or CPU or MPU) of the system or apparatus reading out and executing the program code stored in storage media thereof.

In this case, the program code itself read out from the storage medium realizes the functions of the above-described embodiments, and the storage medium storing the program code makes up the present invention. Accordingly, the form of the program is irrelevant, regardless of whether object code, a program executed by an interpreter, script data supplied to an operating system, or the like, as long as such program functions are had.

Examples of storage media used for supplying the program include flexible disks, hard disks, optical discs such as CD-ROM, CD-R, CD-RW, DVD, magneto-optical disks such as MO, magnetic tape, nonvolatile memory cards, semiconductor ROM, and so forth.

Additionally, a supplying method of the program may be to supply a program by using a browser on a client computer to download from a website on the Internet. That is to say, the website is accessed, and the computer program itself, or a file that is compressed and includes an automatic install function, according to the present invention is downloaded from the website to a recording medium such as a hard disk.

Also, the program code making up the program of the present invention may be divided into multiple files, with each file being downloaded from a different homepage. That is to say, a WWW server or ftp server for downloading a program file as to multiple users in order to realize the functional processing of the above-described embodiments with a computer is also included in the present invention.

Also, the program for realizing the embodiments may be encrypted and stored in a storage medium such as a CD-ROM and distributed to users. A user having cleared predetermined conditions can then download key information to decrypt the encryption from the website via the Internet. The key information therein can be used to execute the encrypted program, thereby installing on the computer and carrying out.

Also, not only an arrangement wherein the computer executes the read out program, whereby the above-described functions of the embodiments can be realized, but also an arrangement wherein, based on the program instructions, the operating system running on the computer performs part or all of the actual processing, whereby the above-described functions of the embodiments can be realized with such processing, is included.

Further, an arrangement is also included wherein the above-described embodiment functions are realized by the program read out from the recording medium being written into memory provided on a function expansion board installed on the computer or a function expansion unit connected to the computer, such that, based on the program instructions thereof, the above-described functions of the embodiments are realized by the CPU provided to the function expansion board or function expansion unit performing part or all of the actual processing.

Further, the present invention may be applied to a system configured of multiple pieces of equipment, or an apparatus configured of one piece of equipment. Moreover, it is needless to say that the present invention can be applied to cases of supplying the program to a system or apparatus to carry out the invention. In this case, the system or apparatus reads out the program which is software for realizing the present invention from a storage medium storing the program, whereby the system or apparatus can benefit from the advantages of the present invention.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-053660 filed Mar. 4, 2008, which is hereby incorporated by reference herein in its entirety.

What is claimed is:

1. A printing system for causing a stacking unit to stack sheets printed by a printing unit, comprising:

a determining unit configured to determine whether or not the same printed data is continuously printed by the printing unit more than a predetermined number of sheets; and a control unit configured to, in a case where it is determined that the same printed data is continuously printed by the printing unit more than the predetermined number of sheets, control the stacking unit so as not to continuously stack more sheets on which the same printed data is printed than the predetermined number.

2. The printing system according to claim 1, wherein the control unit permits, in a case where it is determined that the same printed data is not continuously printed by the printing unit more than the predetermined number of sheets, the stacking unit to continuously stack more sheets on which the same printed data is printed than the predetermined number.

3. The printing system according to claim 1, wherein the control unit controls the stacking unit so as not to continuously stack more sheets on which the same printed data is printed than the predetermined number by restricting settings which can be accepted by an operating unit.

4. The printing system according to claim 3, further comprising:

a print control unit configured to print a sheet bundle set on which printed data corresponding to a plurality of pages is printed by the number of sets accepted by the operating unit, wherein the control unit inhibits, in a case where the number of sets are set equal to or greater than a predetermined number of sets, acceptance of settings for a stacking method for continuously stacking the same page included in the plurality of pages.

5. The printing system according to claim 3, further comprising:

a print control unit configured to print a sheet bundle set on which printed data corresponding to a plurality of pages is printed by the number of sets accepted by the operating unit, wherein the control unit inhibits, in a case where settings for a stacking method for continuously stacking the same page included in the plurality of pages are accepted, the number of sets to be set equal to or greater than a predetermined number of sets.

6. The printing system according to claim 1, wherein the printing system causes one of a plurality of stacking units to stack sheets printed by the printing unit, wherein the determining unit determines whether the sheets on which the same printed data is printed, are stacked by a predetermined stacking unit of the plurality of stacking units, and wherein the control unit restricts, in a case where it is determined that the same printed data is continuously printed more that the predetermined number of sheets and the sheets on which the same printed data is printed are stacked by the predetermined stacking unit of the plurality of stacking units, the stacking unit from stacking more sheets than the predetermined number, and the control unit permits, in a case where it is determined that the same printed data is continuously printed more than the predetermined number of sheets and the sheets on which the same printed data is printed are stacked by a stacking unit other than the predetermined stacking unit of the plurality of stacking units, the stacking unit to stack more sheets than the predetermined number.

7. The printing system according to claim 1, wherein the control unit stops, in a case where is it determined that the same printed data is continuously printed more than the predetermined number of sheets, printing by the printing unit after the predetermined number of sheets is stacked by the stacking unit.

8. The printing system according to claim 1, wherein the control unit permits, in a case where it is determined that the same printed data is continuously printed more than the predetermined number of sheets, a stacking unit different from the stacking unit to stack a next sheet after the predetermined number of sheets is being stacked by the stacking unit.

9. A control method for controlling a printing system for causing a stacking unit to stack sheets printed by a printing unit, comprising:

determining whether or not the same printed data is continuously printed by the printing unit more than a predetermined number of sheets; and controlling, in a case where it is determined that the same printed data is continuously printed by the printing unit more than the predetermined number of sheets, the stacking unit so as not to continuously stack more sheets on which the same printed data is printed than the predetermined number of sheets.

10. The control method according to claim 9, wherein in a case where it is determined that the same printed data is not continuously printed by the printing unit more than the predetermined number of sheets, more of the sheets on which the same printed data is printed than the predetermined number are permitted to be stacked continuously by the stacking unit.

11. The control method according to claim 9, wherein the stacking unit is controlled so as not to continuously stack more sheets on which the same printed data is printed that the predetermined number by restricting settings which can be accepted by an operating unit.

12. The control method according to claim 11, further comprising:

causing the printing unit to print a sheet bundle set on which printed data corresponding to a plurality of pages is printed by the number of sets accepted by the operating unit, wherein in a case where the number of sets is set equal to or greater than a predetermined number of sets, acceptance of settings for a stacking method for continuously stacking the same page included in the plurality of pages is inhibited.

13. The control method according to claim 11, further comprising:

causing the printing unit to print a sheet bundle set on which printed data corresponding to a plurality of pages is printed by the number of sets accepted by the operating unit, wherein in a case where settings for a stacking method for continuously stacking the same page included in the plurality of pages are accepted, the number of sets is inhibited from being set equal to or greater than a predetermined number of sets.

14. The control method according to claim 9, wherein the printing system causes one of a plurality of stacking units stack sheets printed by the printing unit, wherein it is further determined whether the sheets on which the same printed data is printed are stacked by a predetermined stacking unit of the plurality of stacking units, wherein in a case where it is determined that the same printed data continuously more than the predetermined number of sheets and the sheets on which the same printed data is printed are stacked by the predetermined stacking unit of the plurality of stacking units, more sheets than the predetermined number are restricted from being stacked by the stacking unit;

and wherein in a case where it is determined that the same printed data is printed continuously more than the predetermined number of sheets and the sheets on which the same printed data is printed are stacked by a stacking unit other than the predetermined stacking unit of the plurality of stacking units, more sheets than the predetermined number are permitted to be stacked by the stacking unit.

15. The control method according to claim 9, wherein in a case where it is determined the same printed data is printed continuously more than the predetermined number of sheets, printing by the printing unit is stopped after the predetermined number of sheets is stacked by the stacking unit.

16. The control method according to claim 9, wherein in a case where it is determined that the same printed data is printed continuously more than the predetermined number of sheets, a stacking unit different from the stacking unit is permitted to stack a next sheet after the predetermined number of sheets is stacked by the stacking unit.

17. A computer-readable storage medium storing a computer-executable program which is for controlling a printing system for causing a stacking unit to stack sheets printed by a printing unit, the computer-executable program comprising:

a code to determine whether or not the same printed data is continuously printed by the printing unit more than a predetermined number of sheets; and a code to control, in a case where it is determined that the same printed data is continuously printed by the printing unit more than the predetermined number of sheets, the stacking unit so as not to continuously stack more sheets on which the same printed data is printed than the predetermined number.

* * * * *